US011346098B2

(12) United States Patent
Krondorfer et al.

(10) Patent No.: US 11,346,098 B2
(45) Date of Patent: May 31, 2022

(54) EXTENDABLE TOILET AUGER

(71) Applicant: Ridge Tool Company, Elyria, OH (US)

(72) Inventors: Harald Krondorfer, Aurora, OH (US); Christopher Schmauder, Olmsted Falls, OH (US); Jacob Schneider, Grafton, OH (US); James Teets, Lorain, OH (US)

(73) Assignee: Ridge Tool Company, Elyria, OH (US)

( * ) Notice: Subject to any disclaimer, the term of this patent is extended or adjusted under 35 U.S.C. 154(b) by 355 days.

(21) Appl. No.: 16/708,510

(22) Filed: Dec. 10, 2019

(65) Prior Publication Data

US 2020/0190786 A1 Jun. 18, 2020

Related U.S. Application Data

(60) Provisional application No. 62/778,359, filed on Dec. 12, 2018.

(51) Int. Cl.

| | |
|---|---|
| ***E03F 9/00*** | (2006.01) |
| ***E03C 1/302*** | (2006.01) |
| ***B08B 9/045*** | (2006.01) |

(52) U.S. Cl.

CPC ..... *E03F 9/005* (2013.01); *B08B 9/045* (2013.01); *E03C 1/302* (2013.01); *B08B 2209/04* (2013.01)

(58) Field of Classification Search

CPC ..... E03F 9/005; B08B 9/045; B08B 2209/04; E03C 1/302

See application file for complete search history.

(56) References Cited

U.S. PATENT DOCUMENTS

| | | | | |
|---|---|---|---|---|
| 4,104,757 | A | 8/1978 | Silverman | |
| 4,218,802 | A | 8/1980 | Babb et al. | |
| 4,364,140 | A | 12/1982 | Irwin | |
| 4,793,017 | A | 12/1988 | Kaye | |
| 4,956,889 | A * | 9/1990 | Kirk | E03F 9/005 15/104.33 |
| 5,173,984 | A | 12/1992 | Kaye | |
| 5,640,736 | A | 6/1997 | Salecker | |
| 2008/0097351 | A1 * | 4/2008 | Sapia | E03C 1/302 604/267 |
| 2008/0244816 | A1 | 10/2008 | Babb et al. | |
| 2013/0160227 | A1 * | 6/2013 | Rutkowski | G05G 5/00 15/104.33 |

(Continued)

FOREIGN PATENT DOCUMENTS

| | | | |
|---|---|---|---|
| CN | 1784179 | A | 6/2006 |
| CN | 201537748 | U | 8/2010 |

(Continued)

OTHER PUBLICATIONS

CN Search Report; Application No. CN 2019112742325; 3 pages.

(Continued)

*Primary Examiner* — Weilun Lo

(74) *Attorney, Agent, or Firm* — Mark E. Bandy; Rankin, Hill & Clark LLP

(57) ABSTRACT

Augers that utilize a drain cleaning cable which can be rotated and selectively extended or retracted from the auger are described. The augers utilize coupling assemblies that enable easy coupling or decoupling between the drain cleaning cable and a torque transmission shaft of the auger.

19 Claims, 23 Drawing Sheets

(56) References Cited

U.S. PATENT DOCUMENTS

| | | | | |
|---|---|---|---|---|
| 2014/0223679 | A1* | 8/2014 | Silverman | E03C 1/302 15/104.09 |
| 2017/0232484 | A1 | 8/2017 | Kehoe et al. | |
| 2018/0066420 | A1* | 3/2018 | Beck | B25G 3/34 |
| 2018/0080212 | A1 | 3/2018 | Cole et al. | |
| 2018/0142458 | A1* | 5/2018 | Bowles | E03C 1/302 |

FOREIGN PATENT DOCUMENTS

| | | | |
|---|---|---|---|
| CN | 102099067 | A | 6/2011 |
| CN | 203008068 | U | 6/2013 |
| CN | 103442654 | A | 12/2013 |
| CN | 205077567 | U | 3/2016 |
| CN | 108601604 | A | 9/2018 |
| WO | WO9707344 | A1 | 2/1997 |

OTHER PUBLICATIONS

CN Office Action; Application No. CN 2019112742325; 9 pages.
CN Office Action and CN Search Report dated Oct. 19, 2020; Application No. CN 2019112742325; 10 pages.

* cited by examiner

EXTENDABLE TOILET AUGER

FIELD

The present subject matter relates to augers and plumbing tools for clearing stoppages or clogs in waste pipes and particularly those leading from sinks, urinals, and toilets. More particularly, the present subject matter relates to coupling assemblies used in augers for transferring rotary motion to a drain cleaning cable and enabling extension of the cable in a convenient and intuitive manner.

BACKGROUND

Many known augers utilize an arrangement of two concentrically arranged tubes. An outer tube serves as a guide tube, and an inner tube serves as a handle extension. A cable header slides inside the inner tube between various positions. Because of this arrangement, the cable header is generally not accessible to the user. Because the cable header is not accessible, adjustment of the length of cable extending from the auger in many applications is difficult and not readily intuitive for the occasional user and cumbersome overall.

Specifically, in many known augers, a user extends or pushes the drain cleaning cable further into a drain or other region by extending the telescopic handle portion of the auger. This is typically performed by pushing a detent button and pulling the telescopic handle portion from the remaining portion of the auger to increase the overall length of the auger. Once lengthened, the auger end and drain cleaning cable extending therefrom are pushed further into the drain. In order to retract the cable back into the telescopic housing, the user holds or grasps the cable, presses the detent, and slides the telescopic tube back over the cable. This procedure is not intuitive and frequently requires the user to contact dirty water or debris from the drain. Accordingly, a need remains for an improved auger assembly and method of use.

SUMMARY

The difficulties and drawbacks associated with previous approaches are addressed in the present subject matter as follows.

In one aspect, the present subject matter provides a toilet auger having an extendable drain cleaning cable. The auger comprises an auger housing defining a proximal end, an opposite distal end, and a hollow interior extending between the proximal end and the distal end of the housing. The auger also comprises a drain cleaning cable at least partially disposed in the housing. The cable defines a proximal end, an opposite distal end, and a hollow interior extending between the proximal end and the distal end of the cable. The auger also comprises a coupling assembly engaged with the proximal end of the drain cleaning cable. And, the auger comprises a torque transmission shaft at least partially disposed in the hollow interior of the drain cleaning cable. The torque transmission shaft defines a proximal end and an opposite distal end. The coupling assembly enables selective engagement between the torque transmission shaft and the cable. The coupling assembly is sized and configured to be slidably positionable within the hollow interior of the housing.

In another aspect, the present subject matter provides a coupling assembly for selectively engaging and disengaging a torque transmission shaft and a drain cleaning cable. The coupling assembly comprises a threaded coupler having a proximal end, an opposite distal end, and a passage extending therethrough between the proximal end and the distal end. The threaded coupler includes (i) a plurality of axially extending fingers projecting from the proximal end of the threaded coupler, and (ii) a threaded engagement region defined along an outer surface of the threaded coupler. The coupling assembly also comprises a grip nut having a proximal end, an opposite distal end, and a passage extending therethrough between the proximal end and the distal end. The grip nut includes a threaded engagement region defined along an inner surface of the passage in the grip nut. The passage defined in the grip nut is sized and shaped to receive the proximal end of the threaded coupler and the threaded engagement regions of the threaded coupler and the grip nut are configured to threadedly engage each other.

In yet another aspect, the present subject matter provides a coupling assembly for selectively engaging and disengaging a torque transmission shaft and a drain cleaning cable in which the torque transmission shaft defines a plurality of retention depressions along a length portion of the shaft. The coupling assembly comprises a quick release sleeve defining a proximal end, a distal end, and a passage extending between the proximal end and the distal end. The quick release sleeve also includes an interior region of reduced span, and an interior ramp wall extending between the passage and the interior region of reduced span. The coupling assembly also includes a quick release coupling defining a proximal end, an opposite distal end, and a passage extending between the proximal end and the distal end. The quick release coupling also includes a spindle sized and shaped to be received within the passage of the quick release sleeve, the spindle defining at least one ball capture region. The coupling assembly also includes at least one ball sized and shaped to be received in the ball capture region defined in the spindle and also in the retention depressions defined in the torque transmission shaft.

In another aspect, the present subject matter provides a coupling assembly for selectively engaging and disengaging a torque transmission shaft and a drain cleaning cable. The coupling assembly comprises a torsion lock body defining a proximal end, a distal end, an interior passage extending between the proximal and distal ends, and a locking groove region. The coupling assembly also comprises a torsion lock sleeve defining a proximal end, a distal end, an interior passage extending between the proximal and distal ends, and at least one aperture providing access to an interior region of the torsion lock sleeve. The interior region is accessible from the distal end of the sleeve. The proximal end of the torsion lock body is positioned within the interior region of the torsion lock sleeve such that the locking groove region is disposed under and aligned with the aperture defined in the torsion lock sleeve.

In still another aspect, the present subject matter provides a method of clearing blockage in a drain. The method comprises providing an auger having an extendable drain cleaning cable, the auger including (i) an auger housing defining a proximal end, an opposite distal end, and a hollow interior extending between the proximal end and the distal end of the housing, (ii) a drain cleaning cable at least partially disposed in the housing, the cable defining a proximal end, an opposite distal end, and a hollow interior extending between the proximal end and the distal end of the cable, (iii) a coupling assembly engaged with the proximal end of the drain cleaning cable, (iv) a torque transmission shaft at least partially disposed in the hollow interior of the drain cleaning cable, the torque transmission shaft defining a proximal end and an opposite distal end, and (v) an auger tool affixed to the distal end of the drain cleaning cable. The coupling assembly enables selective engagement between the torque transmission shaft and the cable. The coupling assembly is sized and configured to be slidably positionable within the hollow interior of the housing. The method also comprises positioning the auger in a drain to be cleared or unblocked. The method also comprises applying rotational motion to the proximal end of the torque transmission shaft which thereby imparts rotational motion to the coupling assembly, the drain cleaning cable, the distal end of the drain cleaning cable, and the auger tool.

In yet another aspect, the present subject matter provides a method of selectively engaging and disengaging a torque transmission shaft with a drain cleaning cable of an auger. The method comprises providing an auger including (i) an auger housing defining a proximal end, an opposite distal end, and a hollow interior extending between the proximal end and the distal end of the housing, (ii) a drain cleaning cable at least partially disposed in the housing, the cable defining a proximal end, an opposite distal end, and a hollow interior extending between the proximal end and the distal end of the cable, (iii) a coupling assembly engaged with the proximal end of the drain cleaning cable, and (iv) a torque transmission shaft at least partially disposed in the hollow interior of the drain cleaning cable, the torque transmission shaft defining a proximal end and an opposite distal end. The coupling assembly enables selective engagement between the torque transmission shaft and the cable. The coupling assembly is sized and configured to be slidably positionable within the hollow interior of the housing. The method also comprises displacing the coupling assembly beyond the proximal end of the auger housing to thereby expose and make accessible the coupling assembly to a user. The method further comprises actuating the coupling assembly to thereby disengage the torque transmission shaft from the drain cleaning cable. The method additionally comprises axially displacing the torque transmission shaft relative to the drain cleaning cable. And, the method also comprises actuating the coupling assembly to thereby engage the torque transmission shaft to the drain cleaning cable.

In still another aspect, the present subject matter provides a toilet auger having an extendable drain cleaning cable. The auger comprises an auger housing defining a proximal end, an opposite distal end, and a hollow interior extending between the proximal end and the distal end of the housing. The auger also comprises a drain cleaning cable at least partially disposed in the housing. The cable defines a proximal end, an opposite distal end, and a hollow interior extending between the proximal end and the distal end of the cable. The auger further comprises a torque transmission shaft at least partially disposed in the hollow interior of the drain cleaning cable. The torque transmission shaft defines a proximal end and an opposite distal end. The torque transmission shaft is slidably disposed within the hollow interior of the drain cleaning cable and can be extended from the proximal end of the drain cleaning cable.

In yet another aspect, the present subject matter provides a threaded coupler for use in a coupling assembly for selectively engaging and disengaging a torque transmission shaft and a drain cleaning cable. The threaded coupler has a proximal end, an opposite distal end, and a passage extending therethrough between the proximal end and the distal end. The threaded coupler includes (i) a plurality of axially extending fingers projecting from the proximal end of the threaded coupler, and (ii) a threaded engagement region defined along an outer surface of the threaded coupler. At least one of the axially extending fingers includes a region of reduced cross sectional area.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
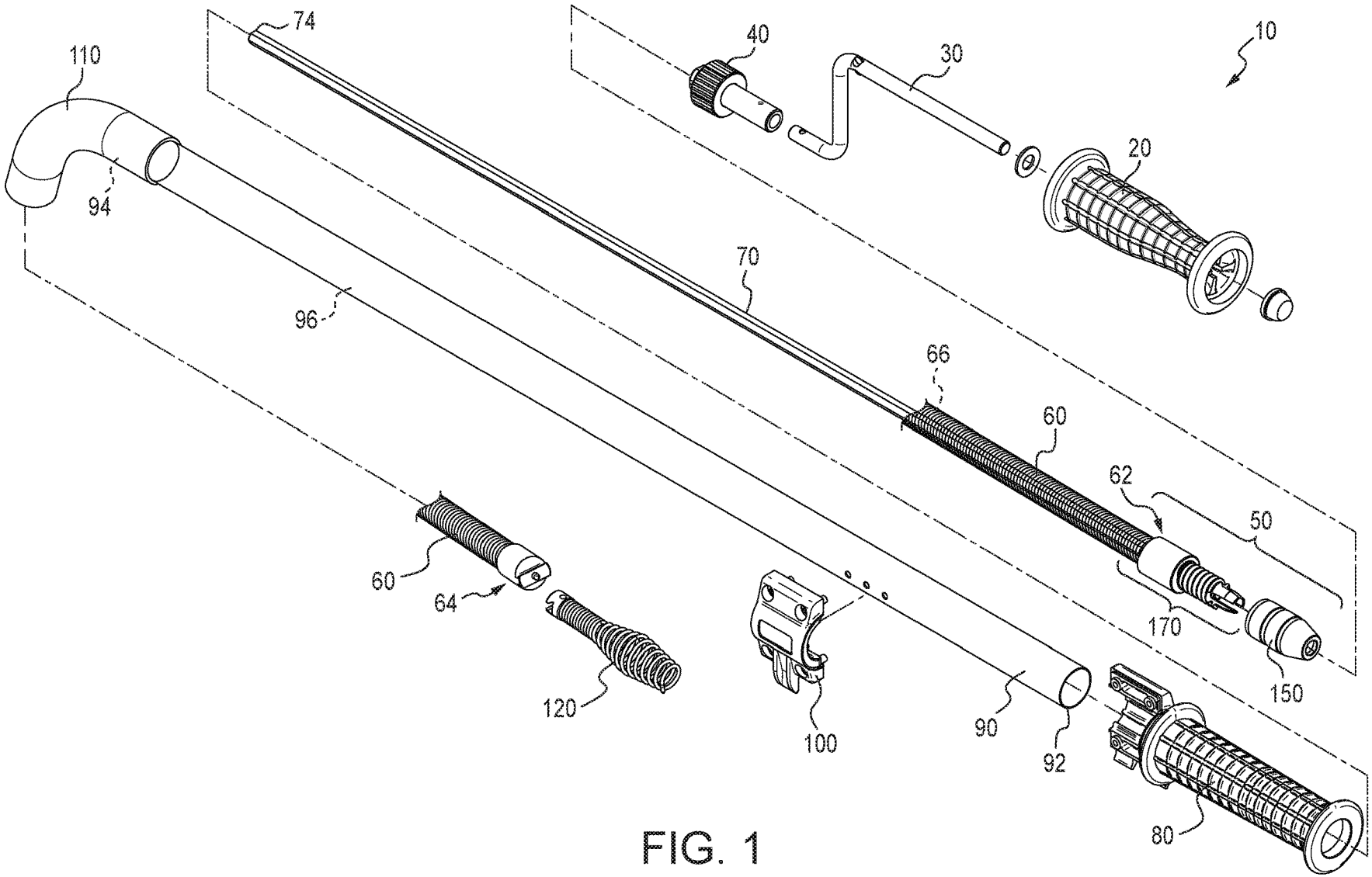
FIG. 1 is a partially exploded assembly view of an embodiment of an extendable toilet auger in accordance with the present subject matter.

The present subject matter relates to coupling assemblies used in extendable toilet augers that enable a torque transmission shaft to be easily disengaged and re-engaged with a drain cleaning cable (or component thereof) to allow extension and/or retraction of the cable relative to the auger. The present subject matter also relates to augers utilizing the coupling assemblies.

In many of the descriptions herein, the terms "distal" and "proximal" are used to refer to particular regions, ends, or portions of components and/or assemblies. These terms as used herein are with respect to positioning of the auger and its components during typical use by a user. That is during use, the proximal region, end or portion of a component is closer to the user as compared to the corresponding distal region, end or portion of that component. And similarly, the distal region, end or portion of a component is farther from the user as compared to the corresponding proximal region, end or portion of that component.

Generally, the augers include a guide tube, outer tube or housing; a flexible drain cleaning cable also referred to in the industry as a "snake;" a cable header which is an end portion of the cable or a component attached to an end of the cable; a coupling assembly attached to the cable header; and a centrally disposed torque transmission shaft, which at least partially is disposed within the cable. The auger also includes engagement provisions for delivering rotary power to the torque transmission shaft such as a manually powered handle or crank, or power engagement assemblies for engaging a power tool such as a handheld drill or the like. Although the description herein is primarily with regard to augers utilizing manually powered handles or cranks, it will be understood that the present subject matter is not limited to such and includes augers driven by electrically powered motors such as in handheld drills.

The coupling assembly serves to connect the drain cleaning cable or snake, to the torque transmission shaft (engaged with a crank handle or other power delivering means) to thereby provide torque transmission from the crank handle to the drain cleaning cable.

To adjust the length of the drain cleaning cable (relative to a distal end of the auger), the user pulls the torque transmission shaft and coupling assembly engaged therewith out of the housing toward the user and past the proximal end of the housing to expose the coupling assembly. The user then disengages a coupling component of the coupling assembly to release the torque transmission shaft from the drain cleaning cable. The user then re-positions the torque transmission shaft relative to the cable. The user then engages the coupling again. The user can now push the cable header along the length of the guide tube and the cable attached to the cable header down the drain, while rotating the cable with the crank handle.

When retracting the cable, the user pulls up the torque transmission shaft toward the user until the coupling becomes accessible. After disengaging the coupling, the user can push the torque transmission shaft inside the cable for storage and re-engaging the coupling.

Typically, the cable header is a proximal end portion of the drain cleaning cable that engages a coupling component of the coupling assembly. In many versions, the cable header threadedly engages an axially extending stem portion of the coupling component such as described in U.S. Pat. No. 4,364,140 herein incorporated by reference. Specifically, the stem portion includes helical groove(s) to mate with the helical coils of the drain cleaning cable. A crimp ring as described in greater detail herein can be used to secure or further secure an end of the cable to the coupling component. However, the present subject matter includes a wide array of engagement provisions to attach a proximal end of the drain cleaning cable to the coupling component.

In a first embodiment, the coupling assembly includes a grip nut and a threaded coupler that provides a friction fit between the torque transmission shaft and the cable header in the axial connection. The torque is transferred through the form fit between the torque transmission shaft which typically exhibits a hexagonal cross sectional shape and the threaded coupler thereby transferring torque from the torque transmission shaft to the drain cleaning cable. In many versions, the torque transmission shaft may have a variety of cross sectional shape(s) such as a n-sided polygon in which n is within a range of from 3 to about 8 or more. For a torque transmission shaft having a hexagonal cross sectional shape, n is equal to 6. It is also contemplated that the torque transmission shaft could exhibit a circular cross sectional shape or a non-circular cross sectional shape.

The threaded coupler can be provided as one or more separate part(s) or can alternatively be integrated with the end of the cable header. In many embodiments, a proximal end of the torque transmission shaft includes a "power groove" connection by which the shaft can be easily connected to an electrically powered drill or other rotary power source. Alternatively or in addition, a crank handle can be provided, that can be connected to the torque transmitting shaft. The advantage of this embodiment in which the coupling assembly utilizes a grip nut and a threaded coupler is that the length position of the cable and torque transmission shaft can be adjusted to near infinitely small increments.

In another embodiment, the coupling is in the form of a quick change coupling and includes a quick release sleeve and a quick release coupling. The quick release coupling includes at least one engagement or locking ball that is engagingly received in peripheral grooves or recessed regions on the torque transmission shaft. In a locked position, the quick release sleeve prevents the ball(s) from moving out of the peripheral grooves. A spring or other member can be used to bias the quick release sleeve to the locked position. When the user moves the sleeve to an unlocked position, the ball(s) can move radially out of the grooves, and the torque transmission shaft can be moved axially relative to the cable header and cable. If used, a torque transmission shaft having a multi-sided polygon cross sectional geometry allows for torque transfer from the crank handle to the cable header independently of whether the quick change coupling is in a locked or unlocked position.

In certain embodiments, the auger and/or coupling assemblies may optionally include a stop. If a stop is provided, there should be an option to override this stop to allow the cable header to be pulled out of the guide tube, typically toward the user. This is typically required to completely retract the distal end of the cable into the guide tube when the guide tube is inserted into the toilet bowl at the beginning of the cleaning operation. One possible way to provide this stop cost efficiently, is by use of wire form as described in greater detail herein. Additional details and aspects of stops are provided herein.

In contrast to known devices, augers of the present subject matter utilize an inverted configuration. That is, instead of a tubular handle extension that houses the cable header, the torque transmission shaft is at least partially stored or otherwise disposed inside the drain cleaning cable. The cable header becomes accessible and the adjustment becomes more intuitive. Significantly, the inconvenient ball detents as used in certain previously known augers that penetrate the handle tube from the inside out are no longer required. Depending on the choice of the coupling assembly, the handle length and the length of the cable that can be fed out into the drain, can be adjusted in increments depending on the number of grooves in the torque transmission shaft or infinitely with a threaded coupler as previously noted. These and other aspects are described in greater detail herein.

FIGS. 1-5 illustrate a toilet auger 10 and components thereof in accordance with the present subject matter. The auger 10 comprises a crank handle 20, a crank 30, and a crank clamp 40. The crank clamp 40 engages the crank 30 and the crank handle 20 to a proximal end 72 (FIG. 4) of a torque transmission shaft 70, preferably hexagonal in cross section, and referred to herein as hex shaft 70, as described in greater detail herein. The auger 10 also comprises a coupling assembly 50 which in this particular embodiment includes a grip nut 150 and a threaded coupler 170 described in greater detail herein. The auger 10 thus comprises a drain cleaning cable 60, the torque transmission shaft 70, a housing handle 80, a housing 90, and a clamp handle 100. The auger typically also comprises a tube sleeve 110, and one or more augers 120 or other tools affixed to the drain cleaning cable 60.

Specifically, referring to FIG. 1, the drain cleaning cable 60 defines a proximal end 62, an opposite distal end 64, and a generally hollow interior 66 extending between the ends 62, 64. The coupling assembly 50 and its components, e.g., the grip nut 150 and the threaded coupler 170 also define passage(s) extending through the components. The torque transmission shaft 70 defines a proximal end 72 (see FIGS. 4 and 5) and an opposite distal end 74. The torque transmission shaft 70 is disposed within at least a portion of the hollow interior 66 of the drain cleaning cable 60, and the passage(s) of the coupling components.

The collection of the torque transmission shaft 70, the drain cleaning cable 60, and the coupling assembly 50 is disposed and more particularly slidingly disposed within a hollow interior 96 of the housing 90. The hollow interior 96 of the housing extends between a proximal end 92 and an opposite distal end 94 of the housing 90.

Although the housing 90 of the auger 10 is illustrated as a hollow tube or cylinder, it will be understood that the present subject matter is not limited to such and includes other shapes and configurations for the housing 90.

As will be understood, the coupling assembly 50 enables a user to selectively affix the cable header, i.e., the proximal end 62, and the drain cleaning cable 60 to a desired location along the length of the torque transmission shaft 70. The coupling assembly 50 also enables a user to selectively decouple a previously affixed cable 60 from the torque transmission shaft 70. Upon affixing the cable 60 to the torque transmission shaft 70, extension or retraction of the torque transmission shaft 70, results in a corresponding linear displacement of the cable 60. And, rotation of the torque transmission shaft 70 results in corresponding rotation of the cable 60. Upon decoupling the cable 60 from the torque transmission shaft 70, the cable 60 can be axially moved independently of the torque transmission shaft 70, and vice versa. In many versions, upon such decoupling, rotation of the torque transmission shaft 70 still results in corresponding rotation of the cable 60. However, the present subject matter includes configurations in which upon decoupling, rotary motion of the torque transmission shaft 70 does not result in rotary motion of the drain cleaning cable 60.

Figure 2:
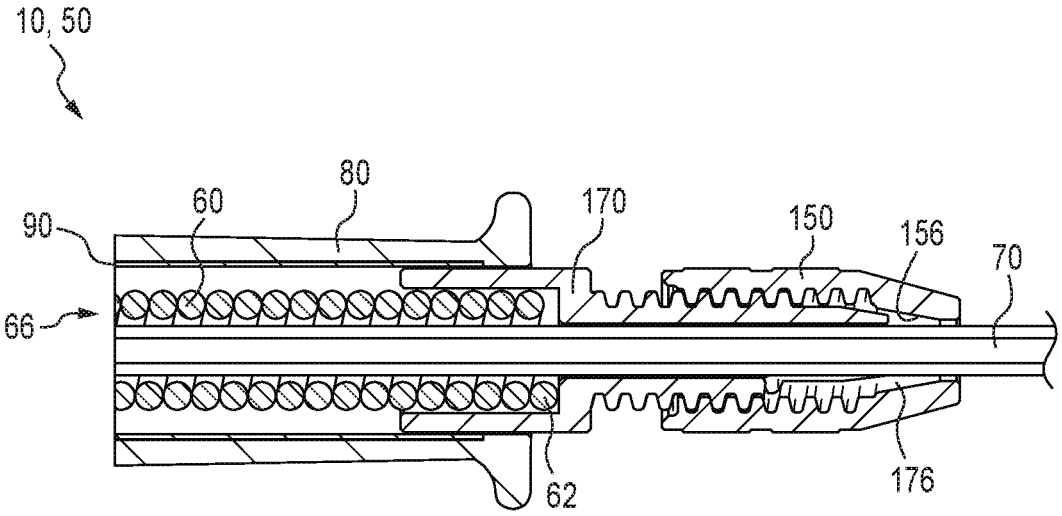
FIG. 2 is a schematic cross sectional view of an embodiment of a coupling assembly of the auger of FIG. 1 in an idle condition in which cable movement is unlocked.
Figure 3:
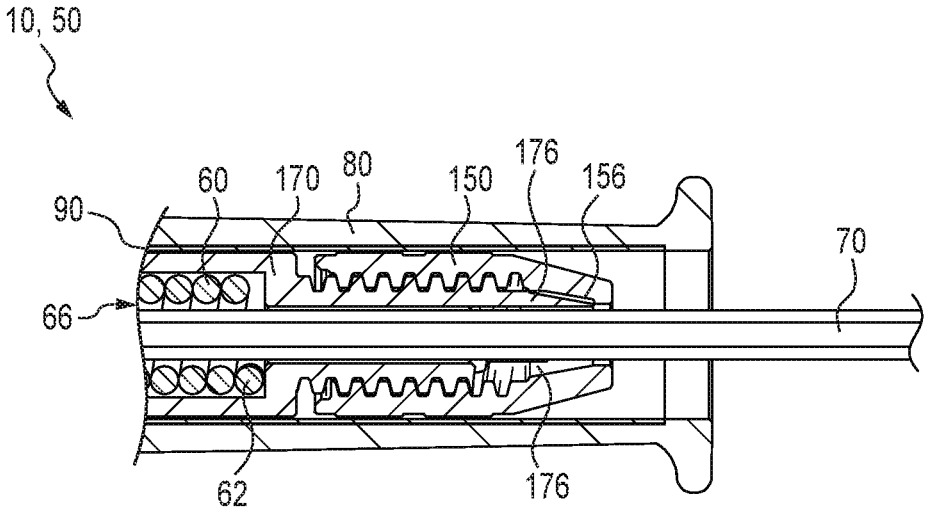
FIG. 3 is a schematic cross sectional view of the coupling assembly depicted in FIGS. 1 and 2 in a working condition in which cable movement is locked.

FIG. 2 illustrates the coupling assembly 50 in an idle condition in which the drain cleaning cable 60 is decoupled from the torque transmission shaft 70. And FIG. 3 illustrates the coupling assembly 50 in a working condition in which the drain cleaning cable 60 is affixed or coupled to the torque transmission shaft 70. In order to couple or affix the cable 60 and shaft 70 together as shown in FIG. 3, the grip nut 150 is threadedly engaged with the threaded coupler 170 from an initially threaded position as depicted in FIG. 2, to a fully engaged threaded position as shown in FIG. 3. As the grip nut 150 is linearly and axially displaced toward the threaded coupler 170, an interior wall 156 of the grip nut 150 urges axially extending fingers 176 of the threaded coupler 170 into contact and engagement with the torque transmission shaft 70 to thereby provide frictional engagement between the shaft 70 and the threaded coupler 170.

Figure 4:
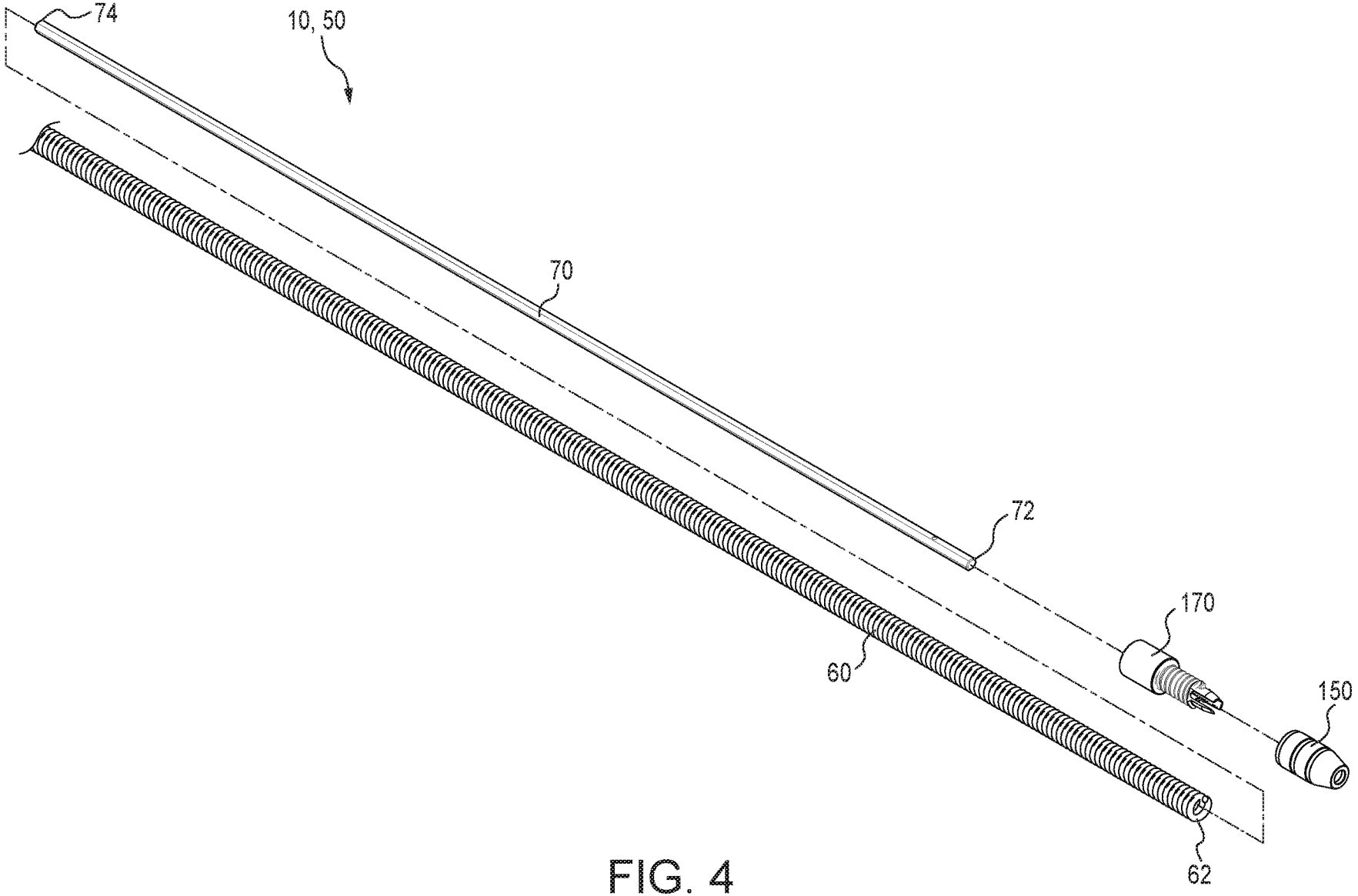
FIG. 4 is a further exploded assembly view of the coupling assembly of the auger of FIG. 1.
Figure 5:
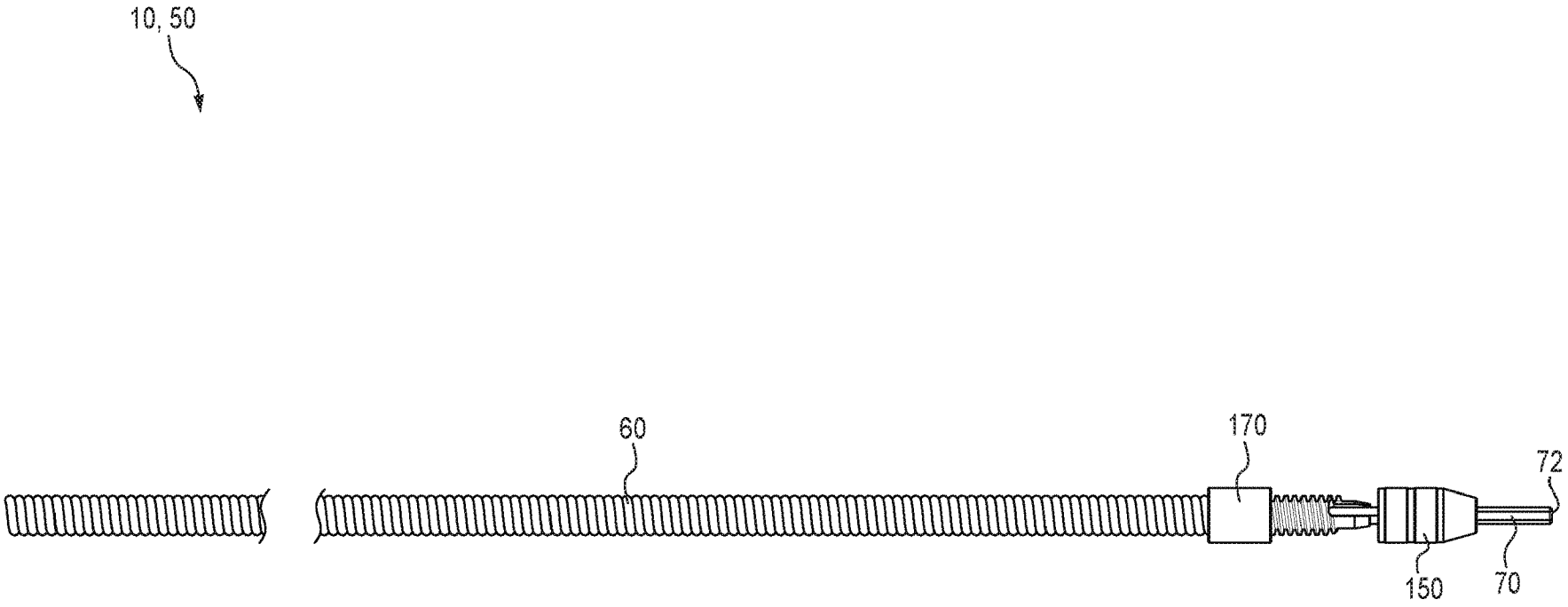
FIG. 5 is a partially assembled view of the coupling assembly depicted FIG. 4.

FIG. 4 is an exploded view of the grip nut 150, the threaded coupler 170, the torque transmission shaft 70, and the drain cleaning cable 60. FIG. 5 illustrates these components in an assembled state. It will be seen that the torque transmission shaft 70 extends through passages and/or interiors of the drain cleaning cable 60, the grip nut 150, and the threaded coupler 170.

Figure 10:
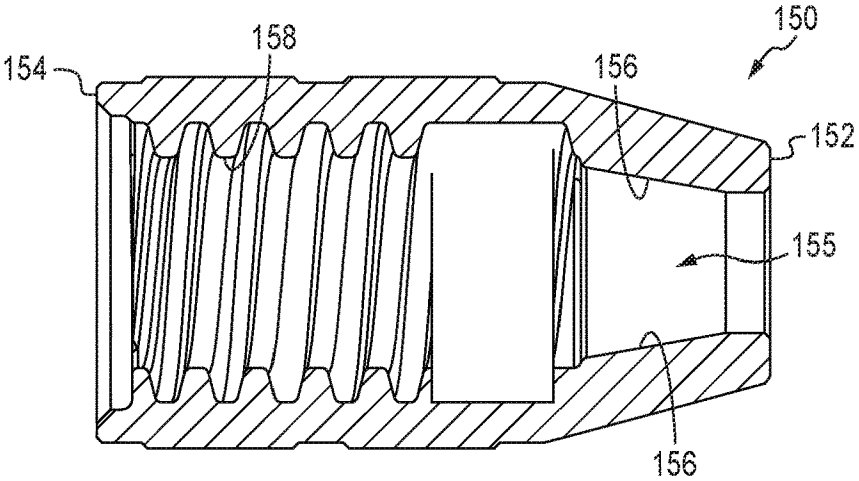
FIGS. 8-11 illustrate a grip nut used in the coupling assembly detailed in FIGS. 4-5.
Figure 8:
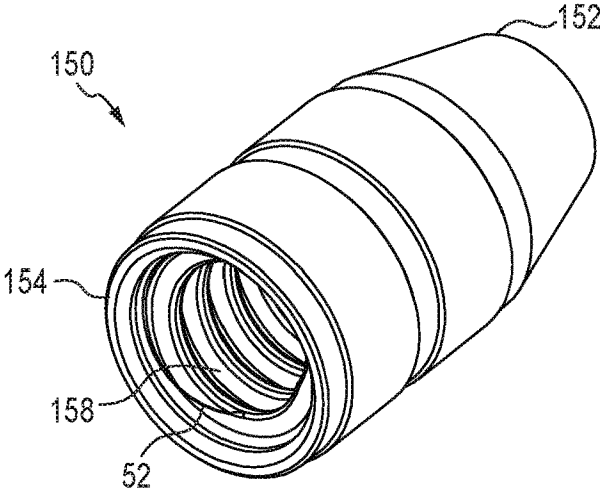
Figure 9:
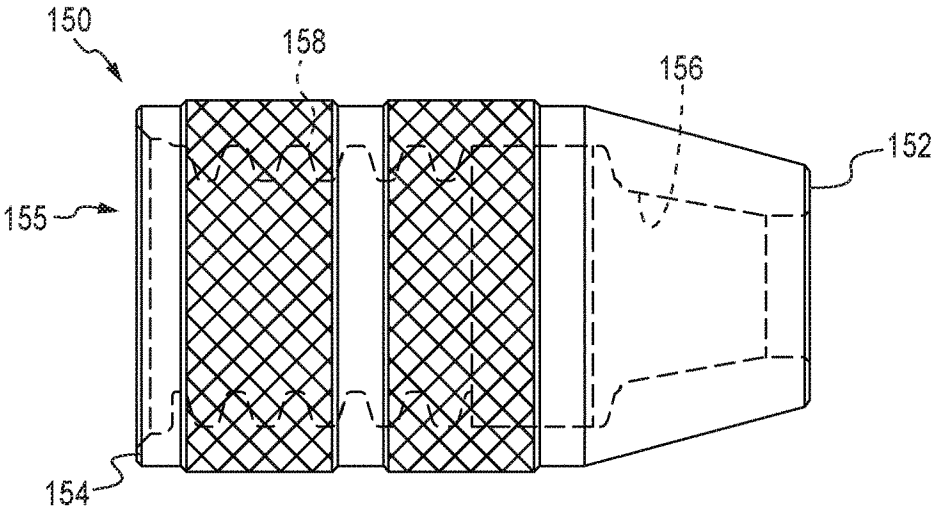
Figure 14:
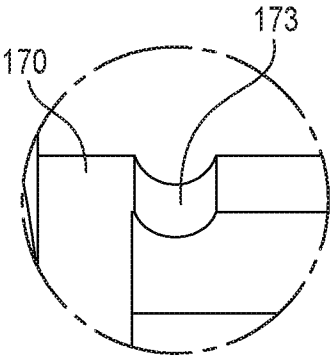
FIGS. 12-15 illustrate a threaded coupler used in the coupling assembly detailed in FIGS. 4-5.

FIGS. 8-11 illustrate in greater detail the grip nut 150 of the coupling assembly 50. The grip nut 150 defines a proximal end 152, an opposite distal end 154, and an interior passage 155 extending between the ends 152, 154. Defined along at least a portion of the passage 155 and adjacent the distal end 154 is a threaded engagement region 158. And, also defined along at least a portion of the passage 155 and adjacent the proximal end 152 is a region of tapering internal engagement wall(s) 156. As shown in FIGS. 9 and 10, the wall(s) 156 taper or transition to a reduced span or opening of the passage 155 as the wall(s) 156 extend toward the proximal end 152 of the grip nut 150.

Figure 15:
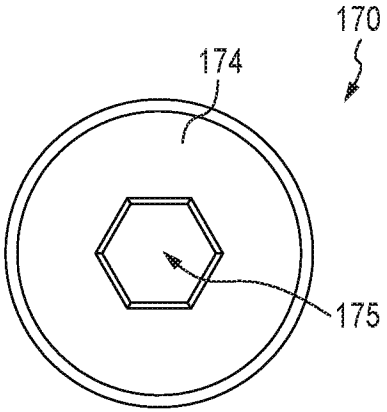
Figure 12:
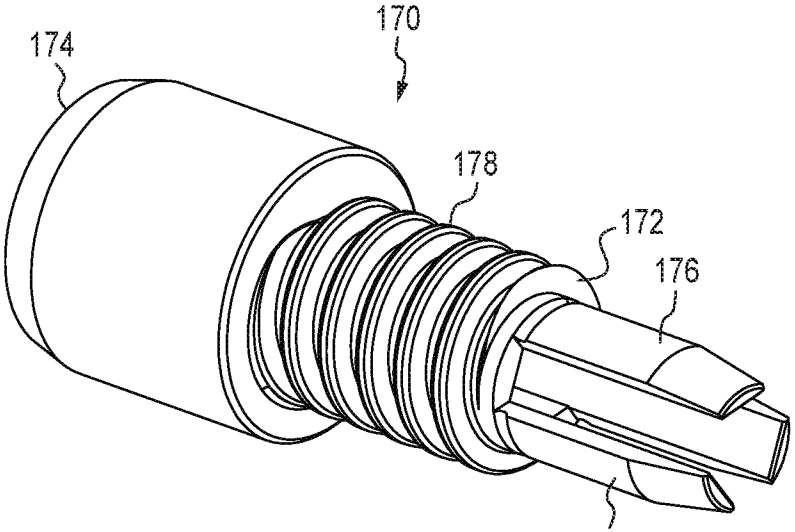
Figure 13:
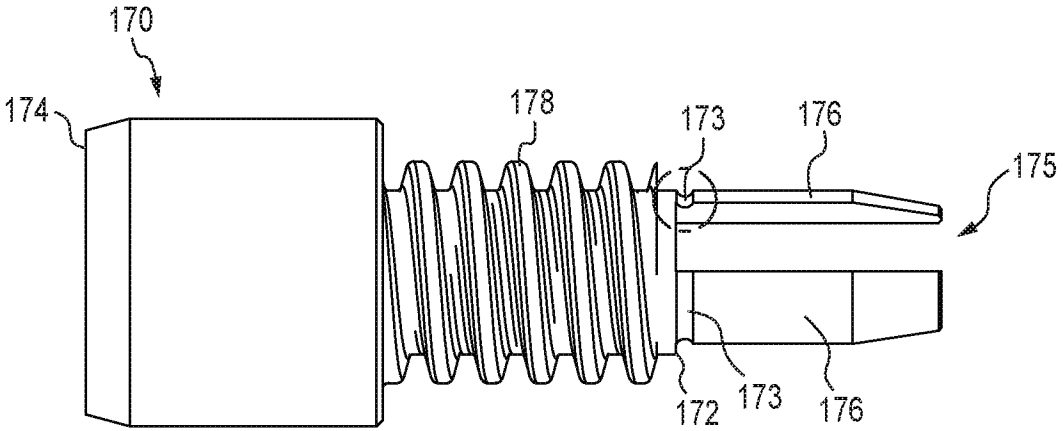

FIGS. 12-16 illustrate in greater detail the threaded coupler 170 of the coupling assembly 50. The threaded coupler 170 defines a proximal end 172, an opposite distal end 174, and an interior passage 175 extending between the ends 172, 174. The threaded coupler 170 also includes one or more, and typically a plurality of, axially extending fingers 176 projecting from the proximal end 172 of the coupler 170. In certain versions of the threaded coupler 170, one or more recessed regions or regions of reduced cross sectional area 173 can be provided to increase flexibility of the fingers 176. The term "region of reduced cross sectional area" refers to a region of the fingers having a reduced width and/or thickness which results in reduced bending stiffness of that finger. The region of reduced cross sectional area can be provided by removing material from the finger(s) of interest along peripheral or exterior portion(s) or by forming holes, apertures, or recesses within the finger(s) of interest. The cross sectional shape of the passage 175 at least at the distal end 174 of the threaded coupler generally corresponds to the cross sectional shape of the torque transmission shaft 70. Thus, for a shaft 70 having a hexagonal cross sectional shape, the passage 175 exhibits a hexagonal cross sectional shape, sized to accommodate and receive the shaft 70. FIG. 15 illustrates the passage 175 exhibiting such a cross sectional shape. The threaded coupler 170 also includes a threaded engagement region 178 defined along an outer surface of the coupler 170. The threaded engagement regions of the threaded coupler and the grip nut, i.e., region 158 of the grip nut 150 and region 178 of the threaded coupler 170, are configured, i.e., sized and shaped, to threadedly engage each other.

Figure 17:
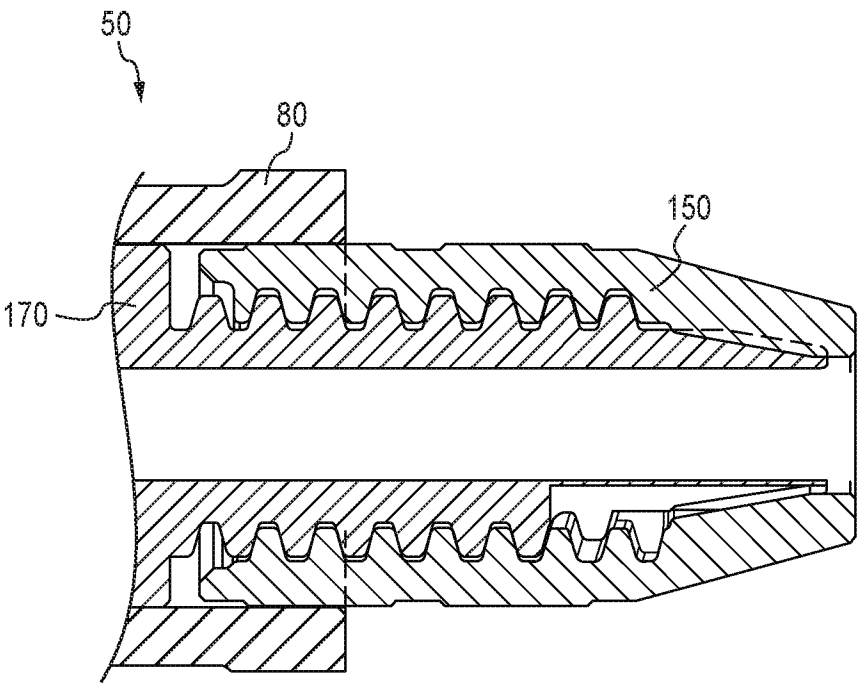
FIG. 17 is a partial cross sectional view showing engagement between the grip nut and the threaded coupler of the coupling assembly detailed in FIGS. 4-5 and 8-16.
Figure 16:
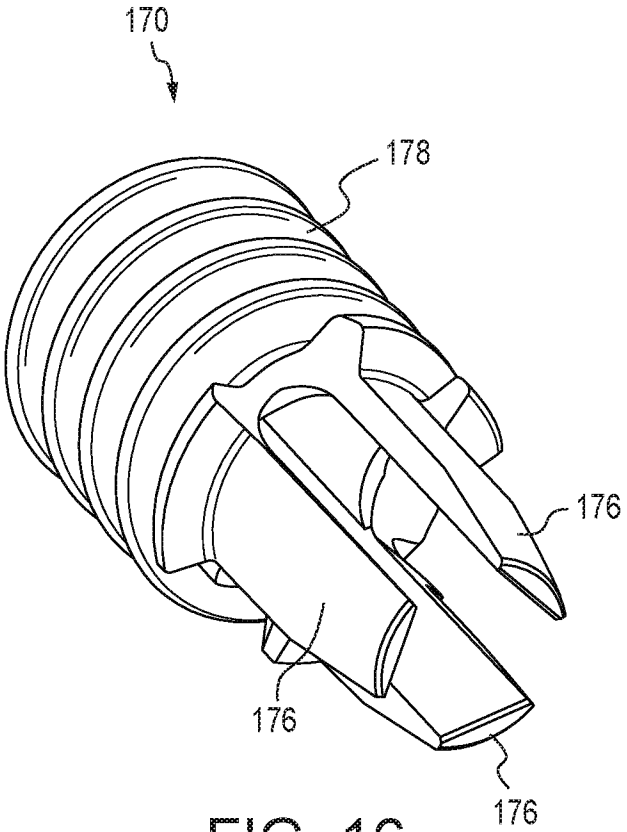
FIG. 16 is a partial perspective detail view of the threaded coupler shown in FIGS. 12-15.

FIG. 17 illustrates threaded engagement between the grip nut 150 and the threaded coupler 170 in the coupling assembly 50.

Figure 11:
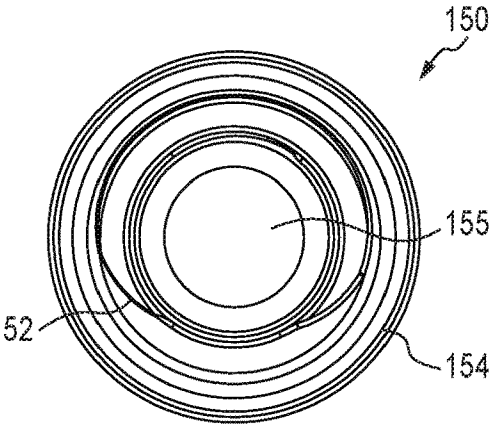

The coupling assembly 50 may also utilize one or more biasing members such as spring(s) 52. The biasing members or spring(s) 52 may serve to promote engagement or disengagement between the grip nut 150 and the threaded coupler 170. A representative example of a spring biasing member 52 is depicted in FIGS. 8 and 11. The spring 52 is positioned within the threaded engagement region 158 of the grip nut 150 and urges disengagement of the threaded engagement region 178 of the threaded coupler 170.

The auger 10 may utilize a quick change coupling assembly 200 instead of the coupling assembly 50 described herein. The coupling assembly 200 and its components are illustrated in FIGS. 6-7 and 18-24.

Figure 6:
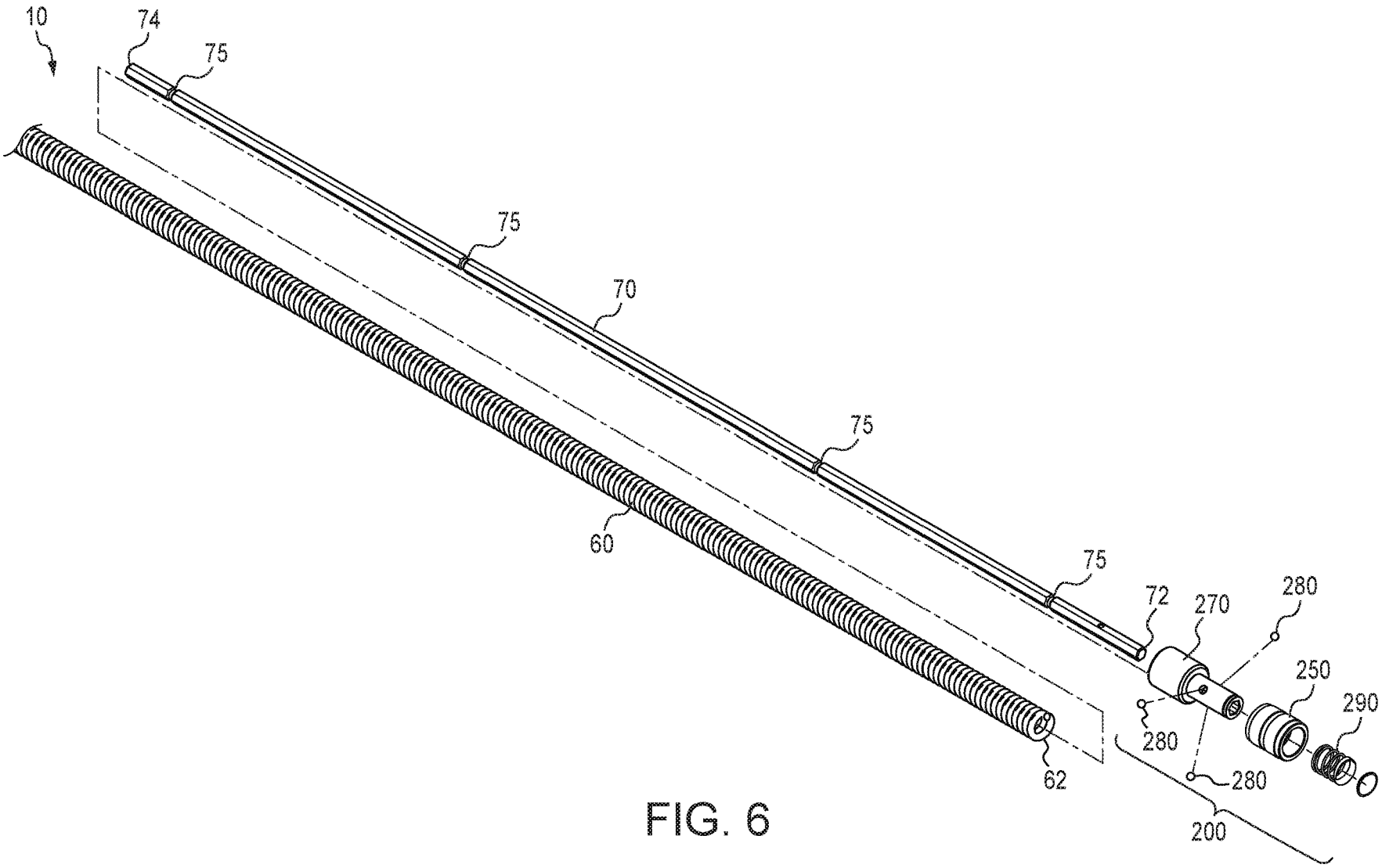
FIG. 6 is an alternate embodiment of a quick change coupling assembly shown in an exploded assembly view in accordance with the present subject matter.
Figure 7:
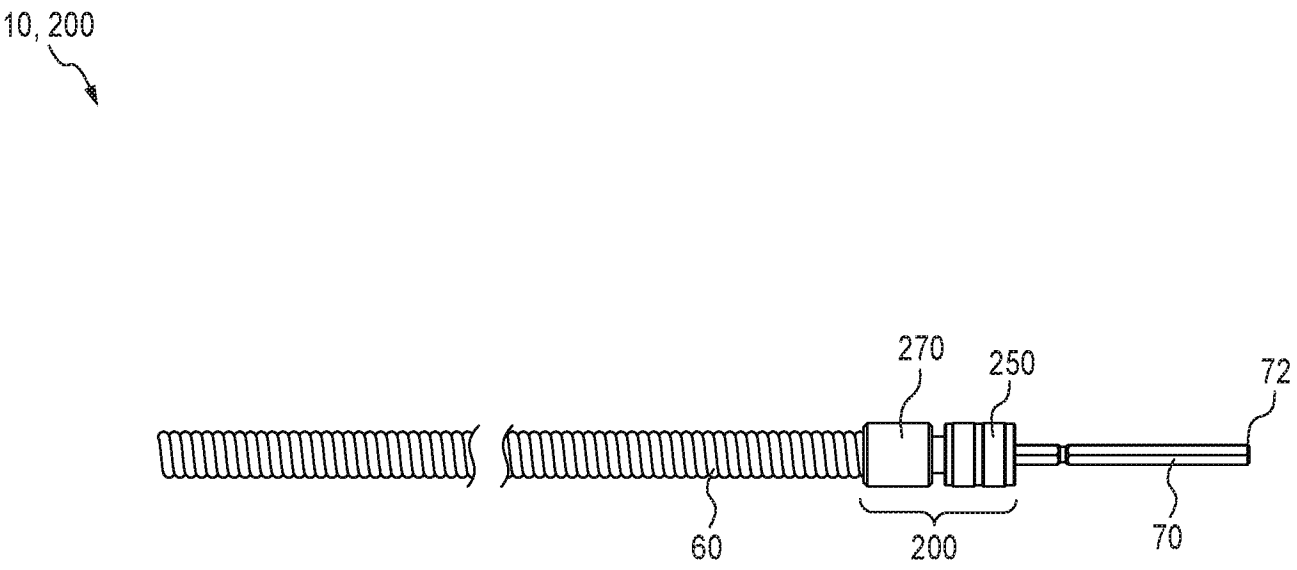
FIG. 7 is a partially assembled view of the quick change coupling assembly of FIG. 6.

Referring to FIGS. 6 and 7, the quick change coupling assembly 200 includes a quick release sleeve 250, a quick release coupling 270, and one or more locking balls 280. If the auger 10 utilizes the quick change coupling assembly 200, the torque transmission shaft 70 defines a plurality of retention depressions 75 along at least a portion of the length of the shaft 70. In many versions, the retention depressions 75 are equally spaced apart. However, the present subject matter includes versions in which the retention depressions are spaced apart unequally from one another. Typically, the plurality of retention depressions includes a total of from 2 to 12 or more, and in many versions a total of 4 retention depressions. The quick change coupling assembly 200 may additionally comprise one or more biasing members 290. The biasing members serve to bias the quick release sleeve 250 to a position relative to the coupling 270 as described in greater detail herein.

Figure 20:
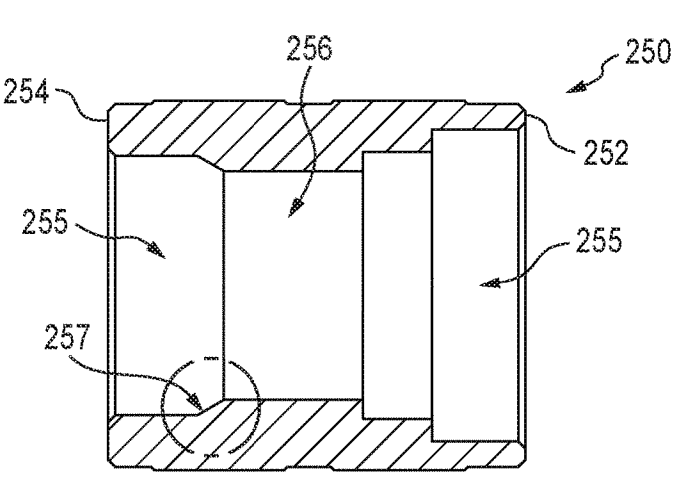
FIGS. 18-21 illustrate a quick release sleeve used in the quick change coupling assembly of FIGS. 6-7.
Figure 21:
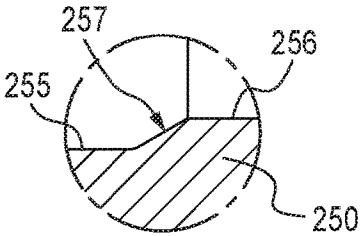
Figure 18:
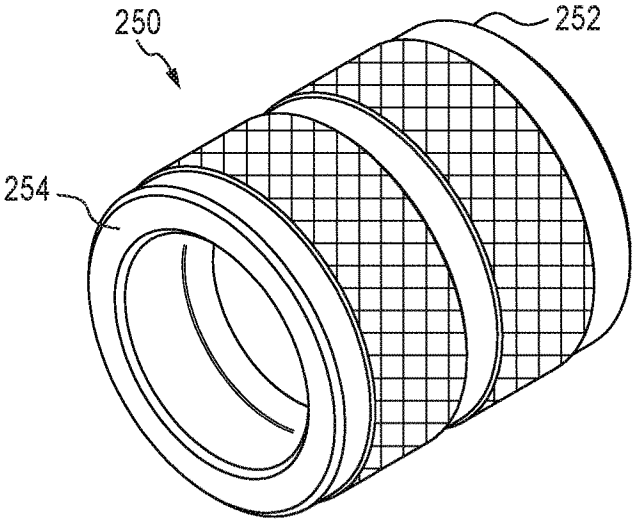
Figure 19:
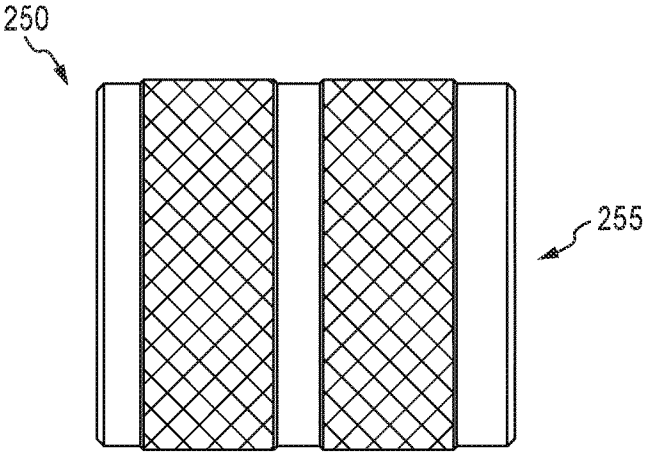

FIGS. 18-21 illustrate a quick release sleeve 250 of the coupling assembly 200. The quick release sleeve 250 defines a proximal end 252, an opposite distal end 254, and a passage 255 extending between the ends 252, 254. The quick release sleeve 250 also includes an interior region of reduced span 256. And, the quick release sleeve 250 includes a tapered wall region or ramp 257 extending between the passage 255 adjacent the distal end 254 and the region of reduced span 256. FIGS. 20 and 21 illustrate in greater detail a representative ramp or wall region 257. As explained in greater detail herein, the ramp 257 serves to urge the one or more locking ball(s) 280 radially inward as the quick release sleeve 250 is positioned over a retention depression 75 defined in the torque transmission shaft 70.

Figure 22:
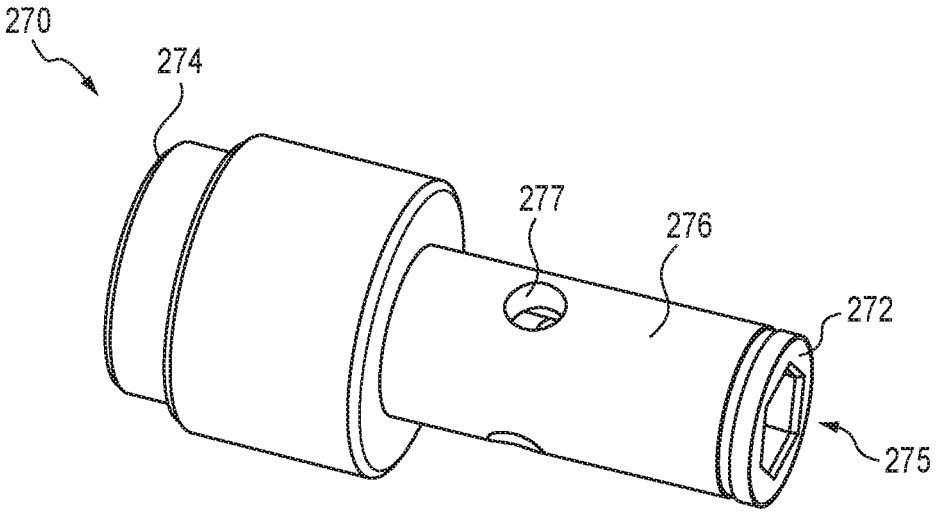
FIG. 22 is a perspective detail view of a quick release coupling used in the quick change coupling assembly of FIGS. 6-7.

FIG. 22 illustrates a quick release coupling 270 used in the quick change coupling 200. The coupling 270 defines a proximal end 272, an opposite distal end 274, and a passage 275 extending between the ends 272, 274. The coupling 270 also includes a spindle 276 which typically exhibits a cross sectional span or diameter that is sized and shaped to be received within the passage 255 and the interior region of reduced span 256 of the quick release sleeve 250. Defined along an outer surface of the spindle 276 is at least one and typically a plurality of ball capture regions 277.

Figure 23:
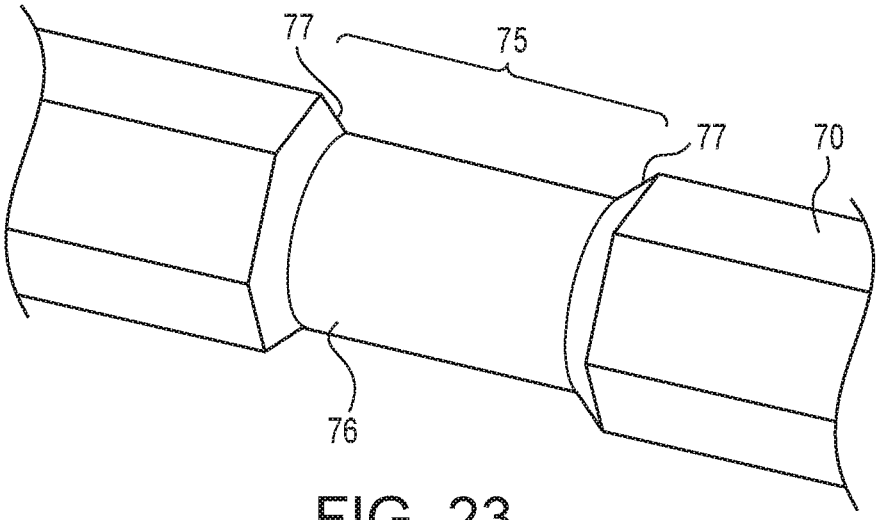
FIG. 23 is a partial perspective detail view of a retention depression in a torque transmission shaft used in association with the quick change coupling assembly of FIGS. 6-7.

FIG. 23 is a detailed view of a retention depression 75 defined or otherwise formed in the torque transmission shaft 70. In certain versions, the retention depression 75 includes a circumferential groove 76 extending about the periphery of the shaft 70 and having a cross sectional diameter that is less than the minimum cross sectional span of the shaft 70 as measured at another location devoid of a retention depression 75. The retention depression 75 can also include a sloping transition wall 77 or a pair of such walls opposing each other, extending between the groove 76 and an outer surface of the torque transmission shaft 70. The width of the groove 76 and/or distance between the sloping transition walls 77 is sufficient to receive a locking ball 280.

Figure 24:
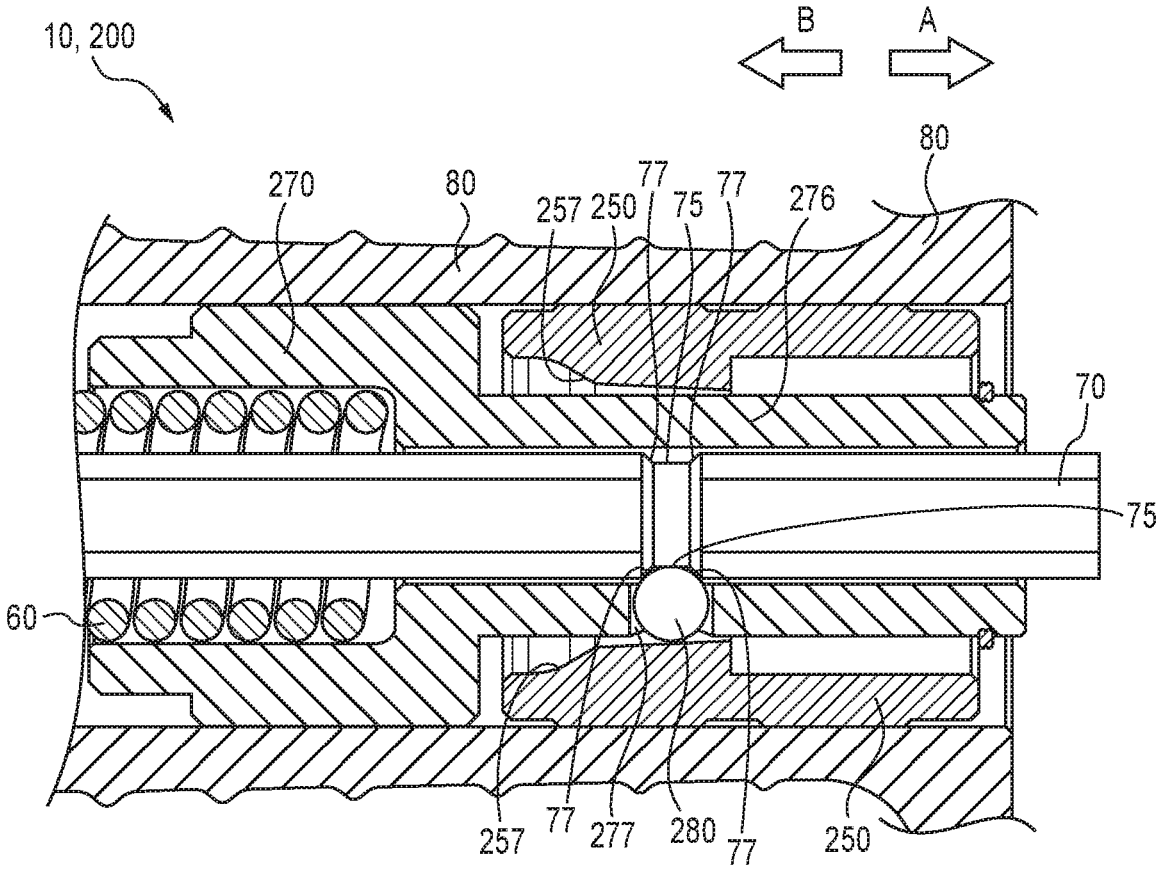
FIG. 24 is a partial cross sectional view of the quick change coupling assembly of FIGS. 6-7.
Figure 24A:
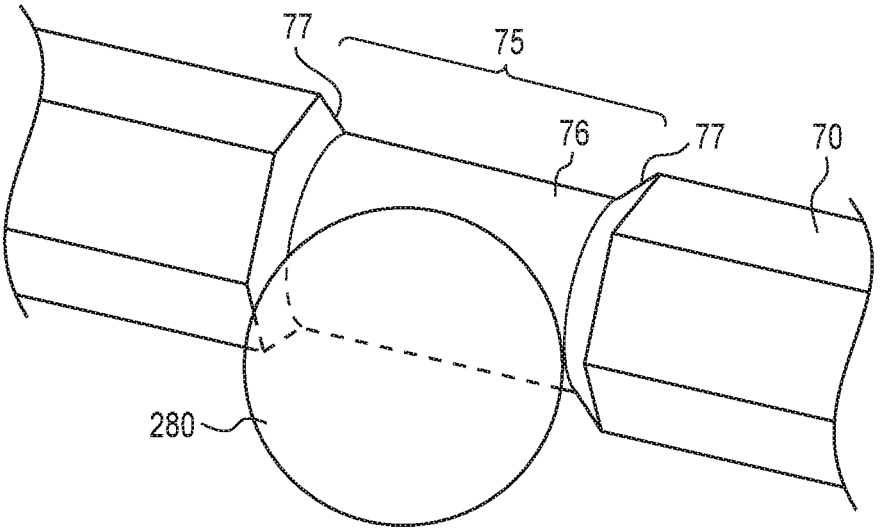
FIG. 24A is a detailed partial perspective view illustrating the retention depression in the torque transmission shaft and a locking ball positioned in the depression.

FIG. 24 is a schematic cross sectional view of the quick change coupling assembly 200 utilized in an auger 10. The coupling assembly 200 is shown disposed within the housing handle 80 of the auger and depicted in a working or locked position in which the drain cleaning cable 60 is coupled to, or engaged with, the torque transmission shaft 70. The torque transmission shaft 70 extends through passages in the coupling 270, the sleeve 250, and the cable 60. In this locked position, the one or more locking ball(s) 280 are disposed in a corresponding retention depression(s) 75 in the shaft 70. The ball(s) are held in the depression 75 by the quick release sleeve 250 positioned over the ball(s) 280. In order to unlock or decouple the assembly 200, the sleeve 250 is linearly displaced away from the coupling 270, which in the FIG. 24 is movement of the sleeve 250 in the direction of arrow A. As noted, the coupling assembly may additionally comprise one or more biasing members 290 (shown in FIG. 6). If used, the biasing members 290 bias the sleeve 250 toward a locked direction, which in FIG. 24 is shown as displacement in the direction of arrow B. FIG. 24A is a detailed partial perspective view illustrating a locking ball 280 positioned in the retention depression 75.

A wide array of drain cleaning cables can be used in association with the augers and coupling assemblies described herein. The cables typically are in the form of a flexible, helically wound wire or metal member. The drain cleaning cable typically has a length of 3 feet or 6 feet, or a length within a range of from 3 to 6 feet. However, the present subject matter includes the use of cables having lengths less than 3 feet or greater than 6 feet.

As previously noted, in certain versions, the augers may include a power groove connection by which the torque transmission shaft can be readily affixed or otherwise engaged with an electrically powered drill. A power groove can be provided by forming or otherwise providing a recessed region within the torque transmission shaft at or near the proximal end of the shaft. The recessed region can be in the form of a retention depression similar to for example, the retention depression 75 described herein, which is adjacent the proximal end 72 of the torque transmission shaft 70. Preferably, the power groove is located within about 0.5 to about 2 inches of the proximal end 72 of the shaft 70. In order to affix or engage a powered drill to the power groove, the crank clamp 40 (see FIG. 1) is loosened to thereby enable separation of the crank clamp 40, the crank 30, and the crank handle 20 from the proximal end 72 of the shaft 70 (see FIG. 4 for example). The drill or other rotary power source can then be affixed or engaged with the proximal end 72 of the shaft 70.

As previously noted, in certain versions of the augers, a stop is provided to prevent the cable header from inadvertently being displaced out of the guide tube or housing and particularly, beyond the proximal end of the guide tube. Thus, the stop serves to retain the cable header and the coupling assembly within the interior of the housing. In many versions, the stop is a component or assembly generally disposed between the proximal end of the housing and the coupling assembly. The stop is typically selectively positionable between a first position in which the stop prevents displacement or movement of the coupling assembly beyond the proximal end of the housing, and a second position in which the stop allows displacement of the coupling assembly beyond or past the proximal end of the housing, to thereby expose and make accessible the coupling assembly to the user.

Figure 25:
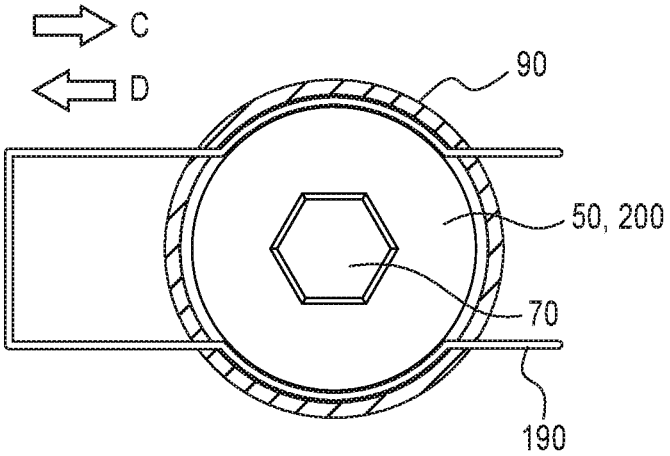
FIG. 25 is a schematic cross sectional view of a portion of an auger illustrating a stop component and positioning of the stop.

The stop can be provided in a wide variety of forms and configurations so long as the stop enables selective displacement of the cable header and coupling assembly out of and/or beyond the proximal end of the guide tube. A representative stop which can be selectively positioned in the auger to prevent or allow displacement of the cable header and coupling assembly out of the guide tube or housing, is shown in FIG. 25. That figure illustrates a cross sectional view of the housing 90 and the proximal end of the coupling assembly 50, 200, and torque transmission shaft 70 disposed within the housing 90. A stop 190 is provided which upon insertion into the hollow interior of the housing 90 (in the direction of arrow C) and between (i) the proximal end of a component of the coupling assembly 50, 200, and (ii) the proximal end of the housing 90, precludes displacement of the coupling assembly 50, 200 beyond the stop 190 and thus prevents the coupling assembly from moving beyond the proximal end of the housing 90. The stop 190 can be placed in an unlocked position by removal or separation of the stop 190 from the guide tube 90 by pulling the stop 190 in the direction of arrow D in FIG. 25. Upon sufficient positioning or removal of the stop 190 relative to the interior of the housing 90, the coupling assembly 50, 200 may then be permitted to move beyond the proximal end and out of the interior of the housing 90.

Figure 26:
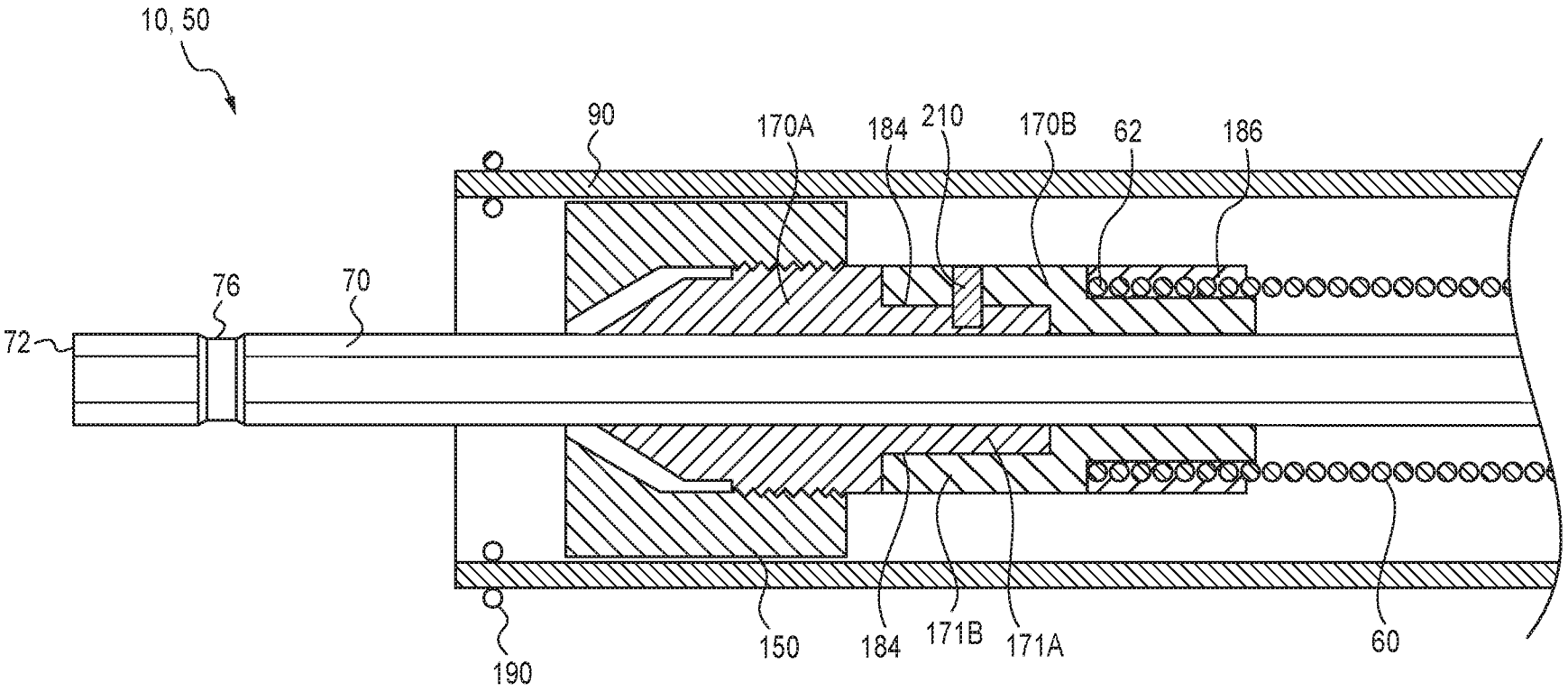
FIG. 26 is a schematic cross sectional view of a portion of another embodiment of an auger coupling assembly illustrating additional details and aspects of the present subject matter.
Figure 27:
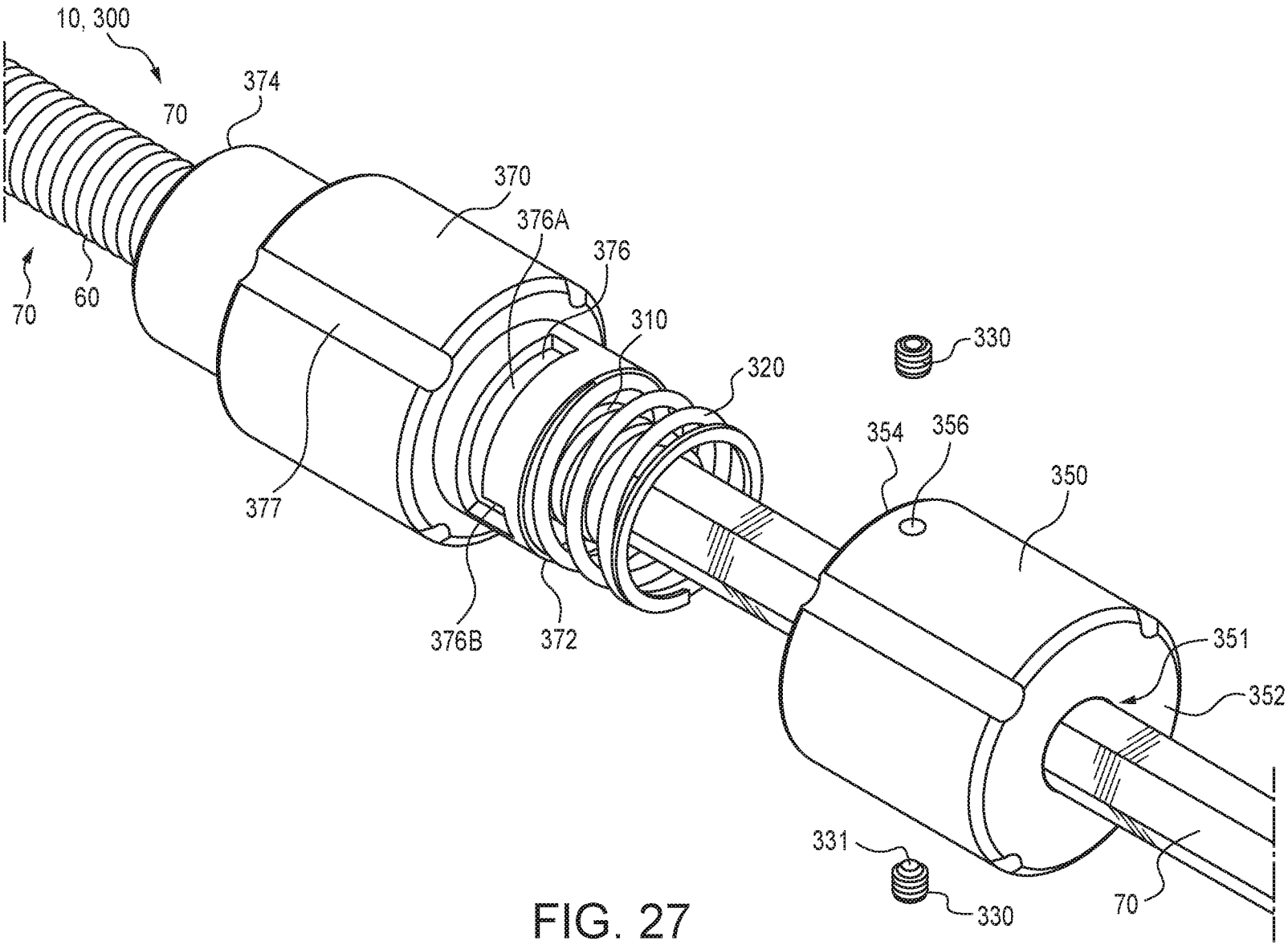
FIGS. 27-30 and 29A-29B are schematic views of another embodiment of an auger coupling assembly in accordance with the present subject matter.
Figure 28:
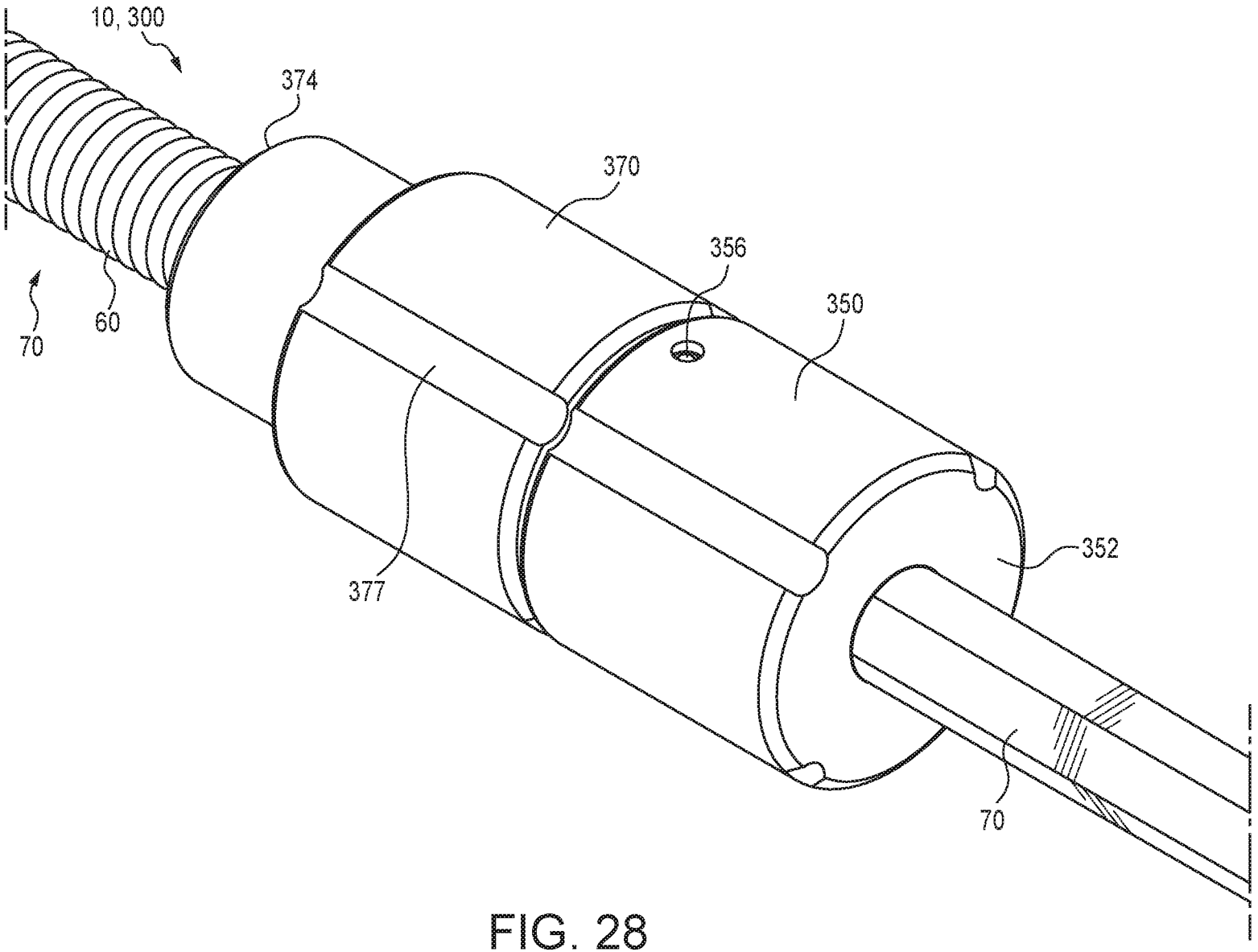

FIG. 26 is a schematic cross sectional view of a portion of another embodiment of an auger 10 having a hybrid cable header assembly. In this version, a modified coupling assembly 50 is depicted that is disposed in a housing 90 and that includes a grip nut 150 that is selectively engageable with a modified threaded coupler 170 as previously described herein. The modified coupler 170 includes a proximal portion 170A and a distal portion 170B. The grip nut 150 and modified coupler 170 each define a hollow passage extending through each component in like fashion as previously described passages 155 and 175. The torque transmission shaft 70 extends through the grip nut 150, the modified coupler 170, and the drain cleaning cable 60. The torque transmission shaft may include a power groove 76 as previously described adjacent the proximal end 72 of the shaft 70.

Referring further to FIG. 26, the proximal portion 170A of the modified coupler 170 is formed from a material different than the material of the distal portion 1706. In many applications, the material of the proximal portion 170A is a material that is less costly and/or that can be more easily shaped or formed than the material of the distal portion 1706. Nonlimiting examples of material for the proximal portion 170A include polymeric materials that can be injection molded. In many applications, the distal portion 1706 is formed from one or more metals such as steel for example.

The proximal portion 170A and the distal portion 1706 of the modified coupler 170 can be affixed to one another in a variety of techniques. In the version depicted in FIG. 26, the assembly includes one or more pin(s) 210 that extend through or into male and female regions of both of the proximal portion 170A and the distal portion 170B. The pin(s) 210 secure and affix the portions 170A and 170B together and particularly in an axial direction. In the particular version of FIG. 26, the proximal portion 170A of the coupler 170 includes a male portion depicted as 171A and the distal portion 170B includes a female portion 171B. The female portion 171B is sized and shaped to receive the male portion 171A. Preferably, the interfacing surfaces of these male and female components shown as interface 184, exhibit non-circular cross sections and in many applications, have a cross section in the shape of an n-sided polygon. This mating configuration promotes torque transfer from the distal portion 170B to the proximal portion 170A. The present subject matter also includes reversal of the male and female portions such that the distal portion 170B can include the male portion, and the proximal portion 170A can include the female portion.

The hybrid cable header assembly illustrated in FIG. 26 may also include a crimp ring 186 that servers to engage the proximal end 62 and adjacent region of the drain cleaning cable 60 to the distal portion 170B of the modified coupler 170.

The present subject matter also includes hybrid cable header assemblies using a modified version of the quick release coupling 270. Thus, in these versions, the coupling 270 includes a proximal portion and a distal portion, in which these portions are formed from differing materials and are coupled together by one or more pins.

FIG. 26 also schematically illustrates the previously described stop 190 which can for example be in the form of a wire member.

Figure 29:
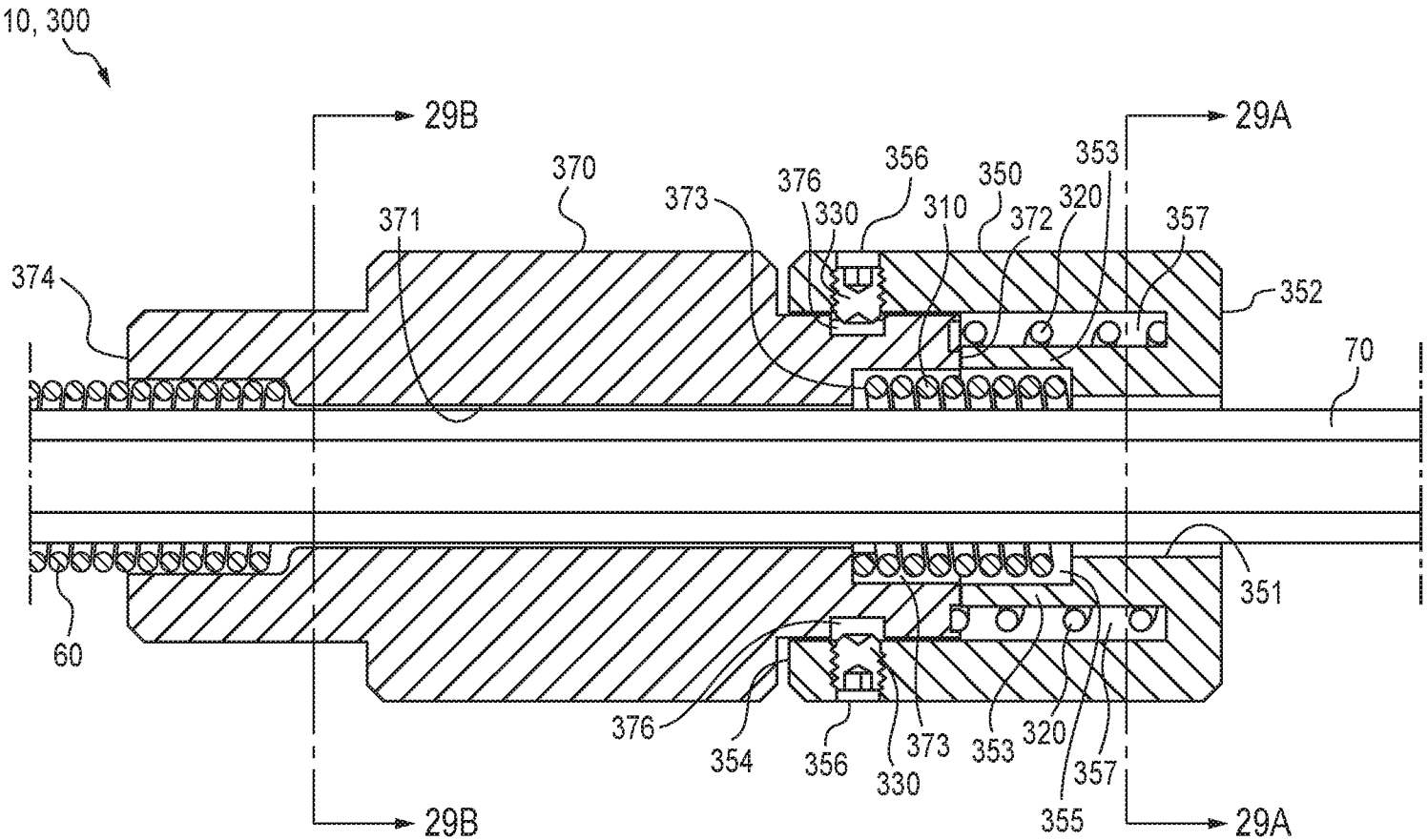
Figure 29A:
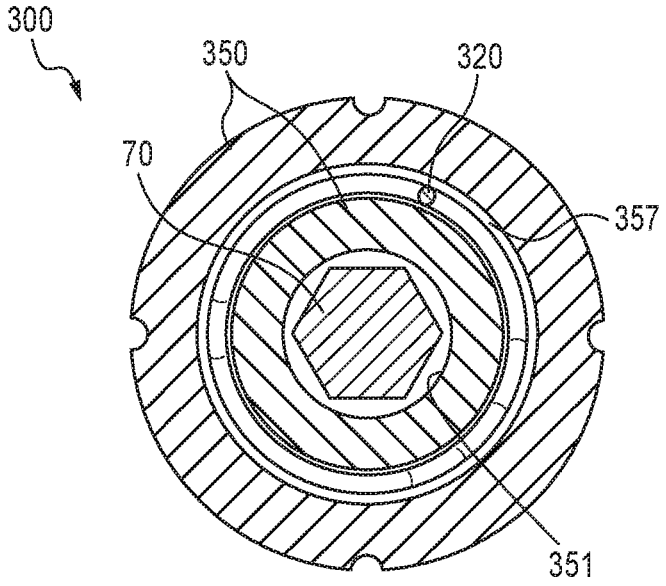
Figure 29B:
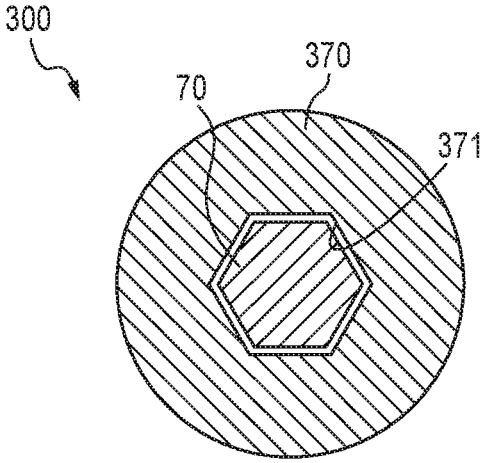
Figure 30:
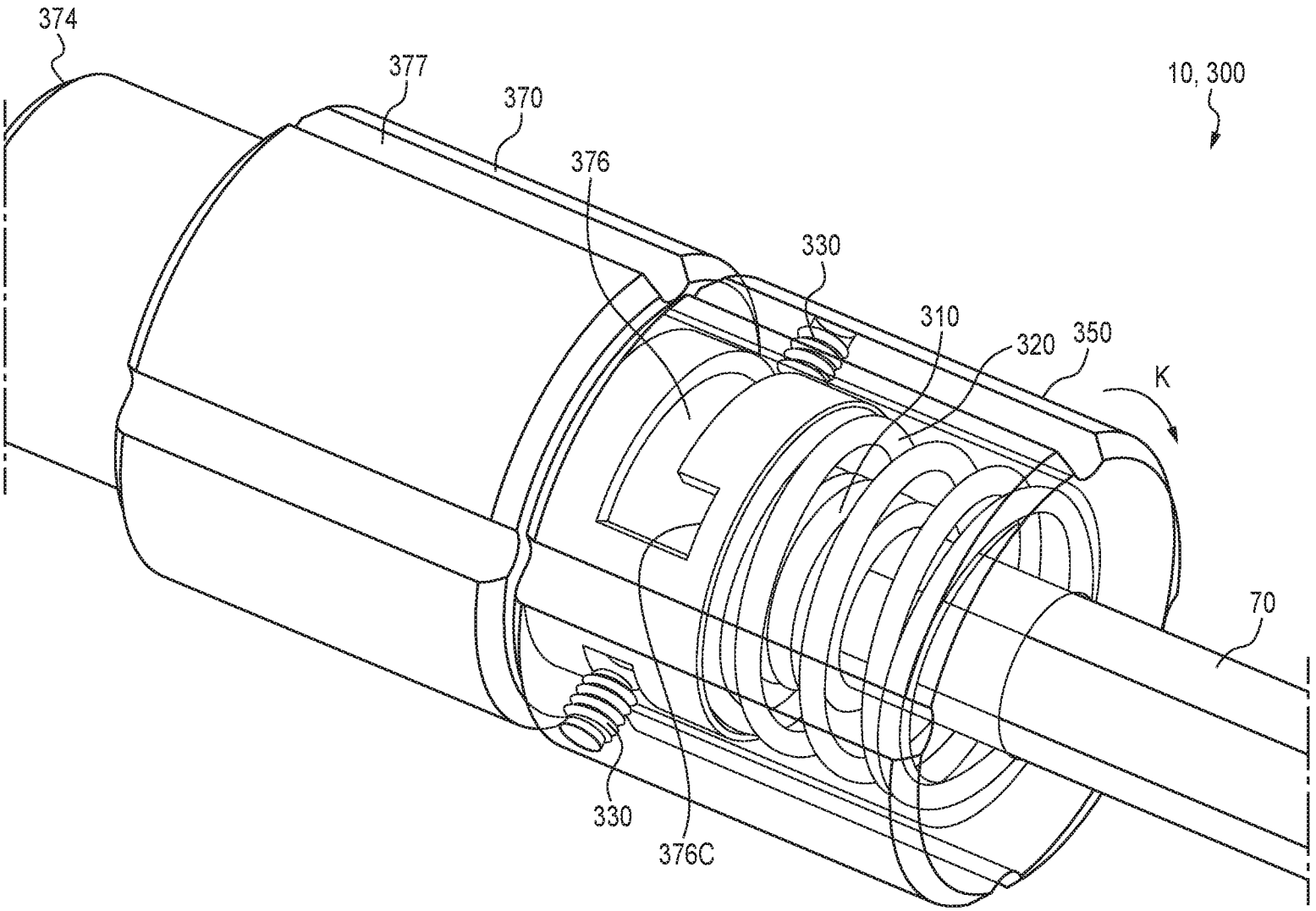
Figure 33:
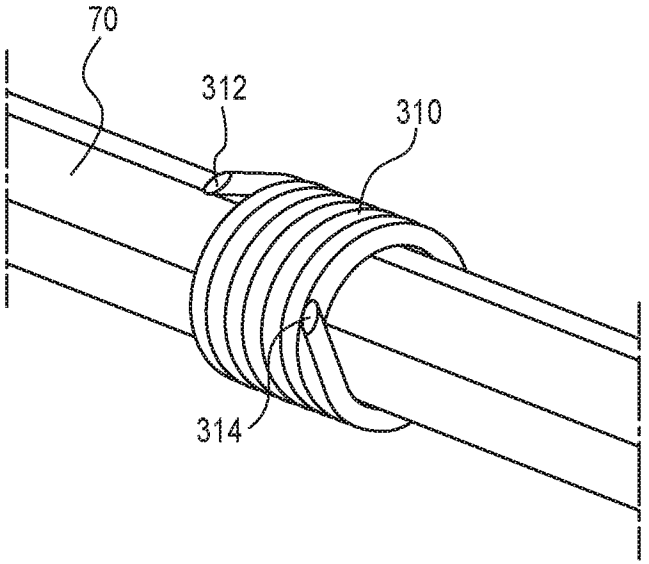

In yet another embodiment of the present subject matter, an auger coupling assembly 300 is provided. The coupling assembly 300 is configured for use with a torque transmission shaft 70 and/or in association with a toilet auger as previously described. Referring to FIGS. 27-32, the assembly 300 comprises a torsion lock body 370 and a torsion lock sleeve 350. To move coupling assembly 300, a user would rotate lock sleeve 350 relative to lock body 370, about a longitudinal axis defined by the hex shaft 70 (FIG. 28), and slide assembly 300 to the left or right (FIG. 29). FIG. 29A is a cross section of the coupling assembly 300 and torque transmission shaft 70 of FIG. 29, taken across section line 29A. FIG. 29B is a cross section of the coupling assembly 300 and torque transmission shaft 70 of FIG. 29, taken across section line 29B. The assembly 300 also comprises a plurality of biasing members, typically a primary spring and a secondary spring. In the embodiment shown in FIGS. 27-32, the coupling assembly 300 comprises a primary torsion spring 310 and a secondary compression spring 320. Torsional spring 310 is preferably axially disposed within compression spring 320, as shown in FIGS. 29 and 30. Torsional spring 310 includes integral end portions 312 and 314, as shown in FIG. 33. When in its normal "relaxed state," the torsional spring 310 bites down on the axially disposed longitudinal edges of hexagonally-shaped torque transmission shaft 70, which essentially "fixes" torsion lock body 370 axially along the length of hex shaft 70. To release torsional spring 310 from the hexagonally-shaped torque-transmission shaft 70, for moving the coupling assembly 300 along the length of hex shaft 70, a user can increase an inner diameter of torsional spring 310, by rotating end portion 314 counterclockwise relative to end portion 312 (FIG. 33). Torsion lock sleeve 350 (FIG. 30) defines retaining structure, such as capture structure 358 (FIG. 32), which is configured to engage and retain one of the end portions 312 and 314 of the torsional spring 310, and the torsion lock body 370 (FIG. 31) similarly defines retaining structure, such as capture structure 378, which is similarly configured to engage and retain the other one of the end portions 312 and 314 of the torsional spring 310. Thus, when the user lets go of the lock sleeve 350, the "relaxed state" of the torsional spring 310 causes the lock sleeve 350 to tighten onto the hex shaft 70. In many versions of the assembly 300, the primary spring 310 is at least partially disposed within an interior region of the secondary spring 320. The coupling assembly 300 may also comprise one or more fasteners or securing elements 330.

The torsion lock body 370 defines an interior passage 371 sized and shaped to slidably receive the torque transmission shaft 70. Interior passage 371, shown as a hexagonal bore, snuggly receives the hexagonally-shaped torque transmission shaft 70 and transfers torque from hex shaft 70 to the coupling assembly 300. Typically, the passage 371 is sized and shaped to allow the lock body 370 to be axially moved with respect to the shaft 70, however not allow rotational movement of the lock body 370 relative to the shaft 70. The torsion lock body 370 defines a proximal end 372 and an opposite distal end 374. As will be understood, a drain cleaning cable 60 is affixed or otherwise secured to the lock body 370 typically at the distal end 374 of the lock body 370. The torsion lock body 370 also defines a recessed receiving region 373 for accommodating at least a portion of the primary spring 310. In many versions, the receiving region 373 is cylindrically shaped, however, the present subject matter includes other shapes for this region and is not limited to a cylindrical shape. The torsion lock body 370 also defines a locking groove region shown as channel 376. The locking groove region 376 in FIG. 30 receives the securing element (s) 330 (FIG. 29) as described in greater detail herein. The locking groove region 376 includes a circumferentially extending portion 376A (FIG. 27) and an axially extending portion or pocket 376B (FIG. 27), terminating with end portion 376C, shown in FIG. 30. The torsion lock body 370 may optionally include one or more slots, ridges, or other regions generally designated as 377 along an exterior surface of the lock body 370 for promotion of gripping or handling by a user.

The torsion lock sleeve 350 defines a proximal end 352 and a distal end 354. The lock sleeve 350 also defines an interior passage 351 extending between the ends 352, 354 and which is sized and shaped to slidably and rotatably receive the torque transmission shaft 70. Typically, the passage 351 is sized and shaped to allow the sleeve 350 to be axially moved and rotated about the shaft 70. The torsion lock sleeve 550 also defines one or more apertures 356 for receiving the securing element(s) 330. In many versions, the aperture(s) 356 and the securing element(s) 330 include threads and so the securing element(s) 330 can be threadedly engaged in the aperture(s) 356. The aperture(s) 356 provide access to an interior region of the torsion lock sleeve 350. That interior region is accessible from the distal end 354 of the sleeve 350.

The torsion lock sleeve 350 includes an interior circumferential wall 353 that separates a generally cylindrical inner receiving region 355 from an outer annular receiving region 357. The inner region 355 is configured to receive the primary spring 310. The outer region 357 is configured to receive the secondary spring 320. In many versions, the lock sleeve 350 includes one or more capture structures 358 within the inner receiving region 355. The capture structure 358 is configured to engage an end of the primary spring 310 which as noted is typically a torsion spring.

Figure 34:
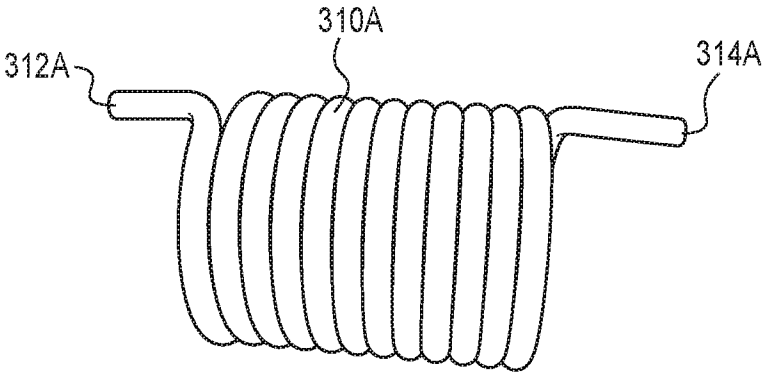
FIGS. 33-34 are schematic views of representative versions of torsion springs used in the coupling assembly shown in FIGS. 27-30.

The torsion lock body 370 and the torsion lock sleeve 350 are adapted to engage each other. In this configuration, the interior passage 371 of the lock body 370 is aligned and generally co-extensive with the interior passage 351 of the lock sleeve 350. As will be understood, the torque transmission shaft 70 extends through the passages 371 and 351. Specifically, a portion and typically a proximal end portion 372 of the torsion lock body 370 is sized for positioning within the torsion lock sleeve 350 and typically within a distal end portion 354 of the sleeve 350. The receiving region 373 of the torsion lock body 370 may also include a capture structure 378 which is configured to engage an end of the primary spring 310. The locking groove region 376 is located along the torsion lock body 370 at a location such that upon engagement between the lock body 370 and the lock sleeve 350, the locking groove region 376 is aligned or disposed underneath the aperture(s) 356 defined in the lock sleeve 350. This arrangement enables an inner face 331 of a securing element 330 to be positioned within the locking groove region 376 of the torsion lock body 370. In many versions, the diameter or interior span of the receiving region 373 of the torsion lock body 370 is the same or substantially so as the diameter or interior span of the inner receiving region 355 of the torsion lock sleeve 350. As noted, upon assembly and incorporation of the primary torsion spring 310 within the regions 373 and 355, one end of the torsion spring 310 engages the capture structure 378 of the torsion lock body 370, and another end of the torsion spring 310 engages the capture structure 358 of the torsion lock sleeve 350. In addition, upon assembly of the components, the proximal end 372 of the torsion lock body 370 is directed toward and in close proximity with the interior circumferential wall 353 of the torsion lock sleeve 350. Upon such assembly, the secondary compression spring 320 is disposed and enclosed within the outer receiving region 357 of the torsion lock sleeve 350. FIG. 34 depicts an alternate, additional embodiment of torsional spring 310A having end portions 312A and 314A. To slide torsional spring 310A longitudinally along the length of hexagonally-shaped shaft 70, a user can increase the inner diameter of spring 310A by rotating end portion 314A clockwise about the longitudinal axis of hex shaft 70 relative to end portion 312A. As discussed above, one of the end portions 312A and 314A of torsional spring 310A would engage capture structure 358 of torsion lock sleeve 350 (or a suitable aperture defined by sleeve 350), while the other one of the end portions 312A and 314A of torsional spring 310A would engage capture structure 378 of torsion lock body 370 (or a suitable aperture defined by lock body 370), so that the torsional spring 310A is able to return to its normal "relaxed" state and cause securing elements 330 (FIG. 30) to move within channel 376 and stop in pocket 376B (FIG. 27), after the user releases hold of torsion lock sleeve 350 relative to torsion lock body 370.

The coupling assembly 300 provides an axially releasable engagement between the assembly 300 and the torque transmission shaft 70. That is, upon engagement of the lock body 370 with the lock sleeve 350 and incorporation of the primary and secondary springs 310, 320 therebetween, the coupling assembly 300 can be selectively affixed at a desired location along the shaft 70 by rotating the sleeve 350 relative to the lock body 370. In this locked state, the securing element(s) 330 are at least partially disposed in the locking groove region 376 and specifically, the axially extending portion 376B. The secondary spring 320 promotes retainment of this locked state by urging the sleeve 350 and specifically the securing element(s) 330 toward an end 376C of the locking groove region 376, as shown in FIG. 30. A user wishing to unlock the coupling assembly 300 urges the sleeve 350 toward the body 370, against the biasing force of the secondary spring 320, thereby moving the securing element(s) 330 away from the end 376C of the locking groove region 376; and then rotating the sleeve 350 in the direction of arrow K relative to the shaft 70 and body 370. Rotation of the sleeve 350 in the direction of arrow K results in loosening and expansion of the primary spring 310 from the shaft 70, thereby allowing axial movement of the sleeve 350 and the body 370 relative to the shaft 70.

FIG. 33 illustrates a primary spring 310 in the form of a torsion spring disposed about a torque transmission shaft 70. The primary spring 310 defines a first end 312 and a second end 314. As will be understood, upon incorporation in the coupling assembly 300, the first end 312 is positioned adjacent the stop structure 378 of the torsion lock body 370 and the second end 314 is positioned adjacent the stop structure 358 of the torsion sleeve 350. The ends 312, 314 can be shaped or configured according to the stop structures or other components of the body 370 and/or sleeve 350. The present subject matter includes a wide array of variations of the springs and components. For example, FIG. 34 depicts a variant primary spring 310A having flat or blunt ends 312A and 314A.

Figure 31:
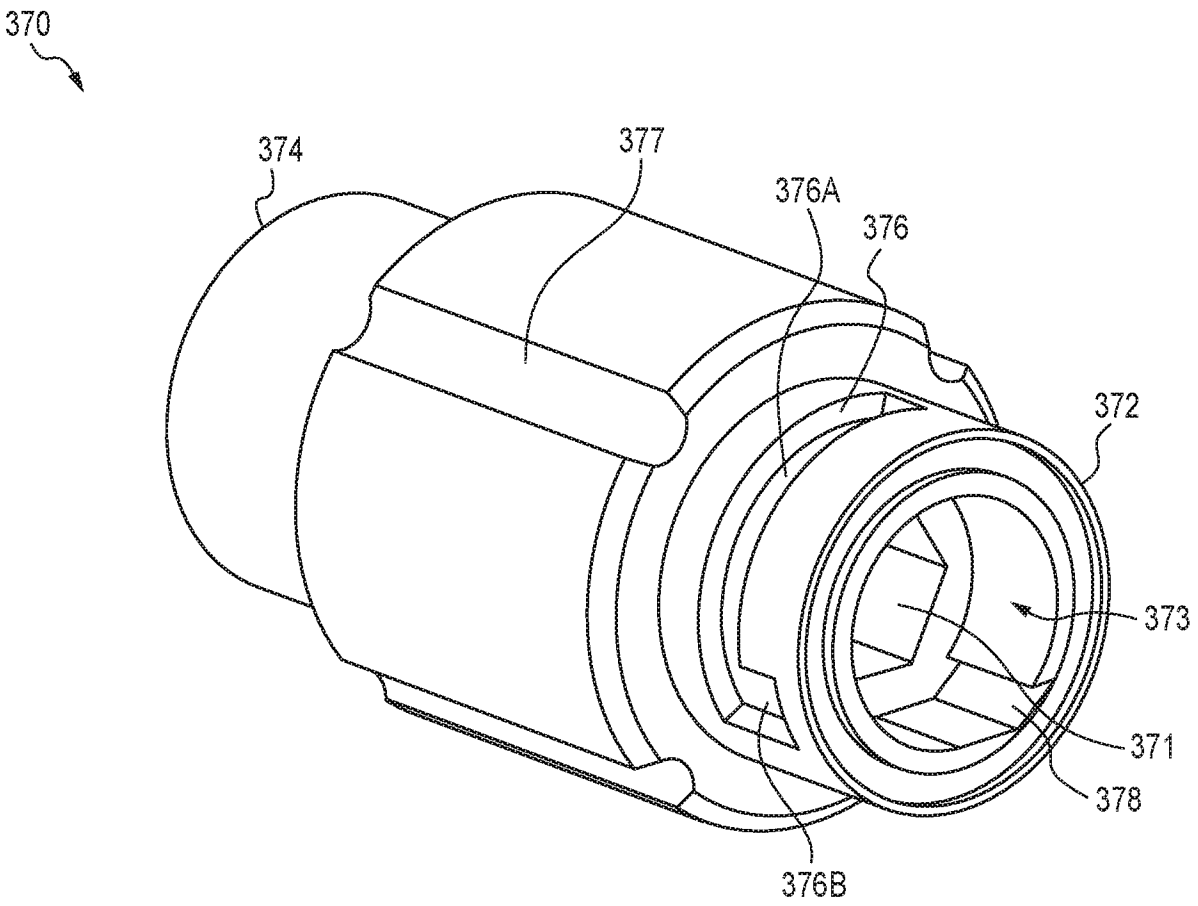
FIG. 31 is a schematic perspective view of a torsion lock body used in the coupling assembly shown in FIGS. 27-30.
Figure 32:
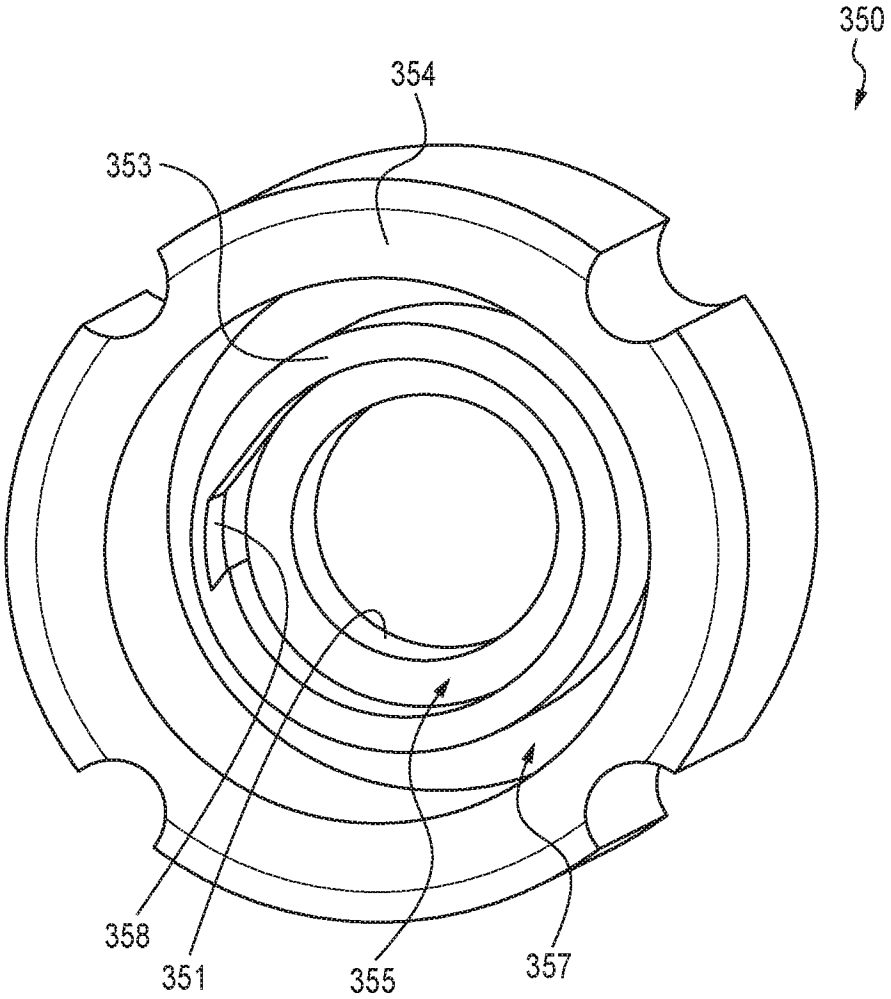
FIG. 32 is a schematic interior end view of a torsion lock sleeve used in the coupling assembly shown in FIGS. 27-30.

In operation, coupling assembly or mechanism 300 (FIG. 28) is capable of freely sliding along the length of torque-transmission shaft 70 until a user causes the coupling assembly or mechanism 300 to be fixed to a desired position along the length of torque-transmission shaft 70. While the preferred embodiment of the torque-transmission shaft 70 is illustrated in, e.g., FIGS. 29A and 29B, as hexagonal in cross section, it can be appreciated that a polygonal-sided torque-transmission shaft, that is, a shaft that is "n"-sided in cross section, where "n" is, e.g., 3-8, would be functionally and operationally equivalent to illustrated shaft 70. The coupling assembly or mechanism 300 includes a torsion spring 310 (FIG. 29) which encircles a portion of the external surface of the elongated torque-transmission shaft 70. Coupling assembly or mechanism 300 also includes a compression spring 320 (FIGS. 27 and 29) encircling a portion of the torsion spring 310. Coupling assembly or mechanism 300 further includes a torsion lock sleeve 350 which defines an inner pocket or inner receiving region 355 (FIGS. 29 and 32) into which one end portion of torsion spring 310 is disposed, and an outer pocket or outer receiving region 357 (FIGS. 29 and 32) within which compression spring 320 is entirely contained. Coupling assembly or mechanism 300 additionally includes a torsion lock body 370. Torsion lock body 370 defines yet another pocket or receiving region 373 (FIGS. 29 and 31) into which the opposite end portion of the torsion spring 310 is disposed. The torsion spring 310 (FIG. 33) is dimensioned relative to the elongated hexagonal-shaped torque-transmission shaft 70 for the purpose of affixing the mechanism 300 along the length of hex shaft 70. In addition, torsion spring 310 is made of a material or materials suitable for enabling the torsion spring 310 to be firmly frictionally-affixed to a portion of the external surface of hex shaft 70 whenever torsion spring 310 is in its normally-"closed" or so-called "relaxed" state. When the torsion spring 310 is in its "relaxed" state, its coiled structure is tightly wrapped around a portion of the elongated torque-transmission shaft 70 (FIG. 33) and frictionally-affixed thereto. To enable a user to operate the coupling assembly or mechanism 300, one of the end portions 312 or 314 of the torsion spring 310 (FIG. 33) is disposed into the inner pocket or receiving region 355 of torsion sleeve 350 and is securely frictionally held there by capture structure 358 (FIG. 32), while the other end portion 312 or 314 of the torsion spring 310 (FIG. 33) is disposed into the other pocket or receiving region 373 defined by torsion lock body 370 and is securely frictionally held there by capture structure 378 (FIG. 31). To enable a user to slide the mechanism 300 (FIG. 28) along the length of shaft 70, the torsion lock body 370 features an interior passage 371, depicted (e.g., in FIGS. 29B and 31) as a hexagonal through-bore that snuggly axially receives hexagonally-shaped torque transmission shaft 70 (FIGS. 27-30). Interior passage 371 (FIG. 29B) also serves to "tie" torsion lock body 370 to torque-transmission shaft 70, so that when the user rotates lock body 370 about the longitudinal axis of shaft 70, shaft 70 is rotated about its longitudinal axis as well, which transfers torque from lock body 370 to hexagonal shaft 70. Torsion lock body 370 also defines a locking groove region 376 which includes a circumferentially-extending portion 376A and an axially-extending portion or pocket 376B, shown in FIG. 27, for rotating one of the torsion lock sleeve 350 and lock body 370 relative to the other about the longitudinal axis of torque-transmission shaft 70, which enables a user either to affix mechanism 300 to or release mechanism 300 from shaft 70. Torsion lock sleeve 350 includes securing elements 330 (FIG. 30), which have an end portion 331 (FIG. 27) configured for insertion into locking groove region 376, shown in FIGS. 29 and 30. When the components of the mechanism 300 (FIG. 28) described above are assembled, compression spring 320 in outer pocket or receiving region 357 (FIG. 29) of torsion sleeve 350 is compressed. To release the mechanism 300 from hex shaft 70, one end portion 312 or 314 of the torsion spring 310 is caused by a user to rotate (e.g., counterclockwise in FIG. 33) relative to the other (end portion 312 or 314 of torsion spring 310) about the longitudinal axis of the hex shaft 70, which "opens" spring 310 and releases the tight grip that spring 310 has on hex shaft 70. To operate mechanism 300, a user must rotate one of torsion lock sleeve 350 and torsion lock body 370 (FIG. 28) relative to the other about the longitudinal axis of hex shaft 70. This will cause the end portion 331 (FIG. 27) of a securing element 330 to be moved within locking groove region 376. When the end portion 331 of a securing element 330 arrives at axially-extending portion or pocket 376B (FIG. 27), the compressive-force in compression spring 320 causes the end portion 331 of securing element 330 to abut end portion 376C (FIG. 30) of groove 376. This increases the gap between lock sleeve 350 and lock body 370 along the longitudinal axis of shaft 70. In a preferred embodiment of mechanism 300, lock sleeve 350 and lock body 370 are spaced about 2 millimeters apart when mechanism 300 is "fixed" to shaft 70 (FIG. 28) and are spaced about 4 millimeters apart when the mechanism 300 is free to move along the length of shaft 70. Torsion spring 310, when relaxed, tightly grips hex shaft 70. As a result, a user must rotate one of torsion lock sleeve 350 and torsion lock body 370 relative to the other about a longitudinal axis defined by hex shaft 70, to force torsion spring 310 to "open," releasing its "grip" on hex shaft 70 and allowing a user to freely move the mechanism described above longitudinally along shaft 70.

Figure 36:
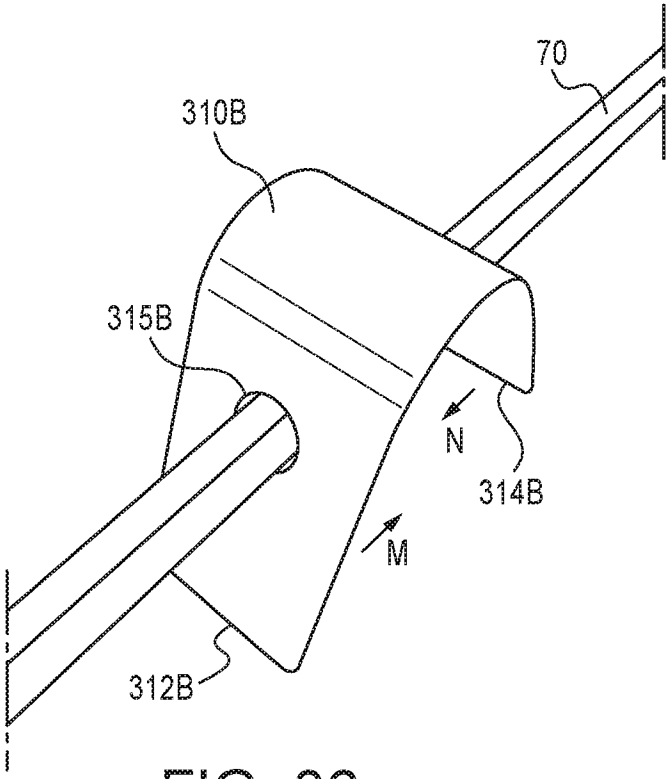
FIGS. 35-36 are schematic views of another version of a spring component that could be used in association with the coupling assembly shown in FIGS. 27-30.
Figure 35:
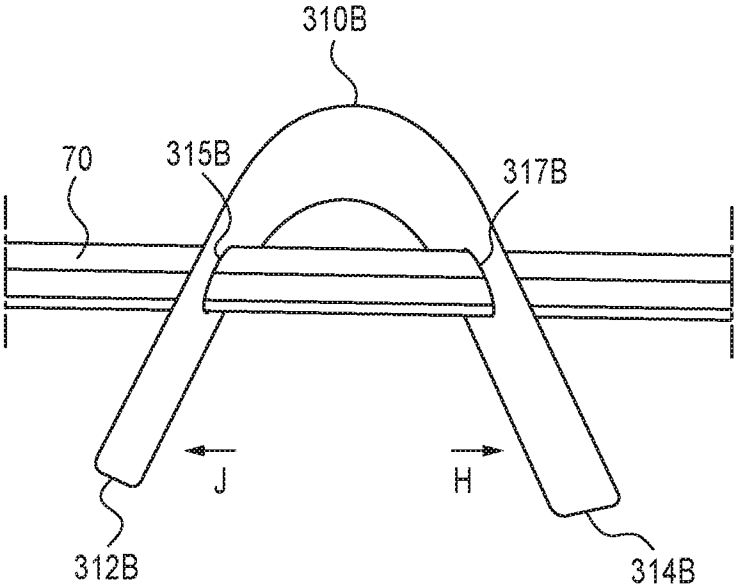

FIGS. 35 and 36 schematically illustrate another version of biasing component(s) that could be utilized or incorporated in a coupling assembly in an auger as described herein. In this version, a biasing component 310B is provided which defines opposite ends 312B and 314B and two apertures 315B and 317B. The biasing component 310B is positioned at a desired location on a torque transmission shaft 70 by bending or otherwise positioning the component 310B so that the apertures 315B and 317B are aligned and the shaft 70 extends therethrough. The material of the component 310B is such that the component adopts a relatively flat shape at rest and must be urged to the shape as shown in FIG. 36 by applying force to the ends 312B and 314B. Specifically, end 312B is urged in the direction of arrow M toward end 314B; and end 314B is urged in the direction of arrow N toward end 312B. Upon force removal, the elastic or resilient behavior of the material of the component 310B results in releasable retention or securement of the component 310B to the shaft 70. That is, due to the noted material behavior, the end 312B is urged outward in the direction of arrow J in FIG. 35, and the end 314B is urged outward in the direction of arrow H. Nonlimiting examples of suitable materials for the biasing component 310B include but are not limited to steel, stainless steel, and various metal alloys known for deformable and elastic properties.

The present subject matter also provides methods of clearing blockage(s) in drains. The methods involve providing an auger as described herein. The methods also include positioning the auger in a drain to be cleared or unblocked. Specifically, this typically includes inserting the auger tool attached to the distal end of the drain cleaning cable, into the drain until the auger tool contacts the blockage. The user applies rotational motion to the torque transmission shaft. As previously described, the rotational motion can be applied manually such as by movement of a crank or other handle, or by application of a powered source of rotary motion. Rotation of the torque transmission shaft results in rotating of the coupling assembly, the drain cleaning cable, and the auger tool attached to the distal end of the drain cleaning cable. The method of use may also include the user urging the auger tool further into the drain. Typically, this is accompanied by continuous or intermittent rotary motion of the drain cleaning cable and auger tool attached thereto.

It may be necessary or desirable to further extend the drain cleaning cable from the distal end of the auger housing. In accordance with the present subject matter, this procedure is as follows. The user moves or otherwise displaces the coupling assembly beyond or past the proximal end of the auger housing. This typically involves pulling the coupling assembly out of the auger housing to thereby expose and make accessible the coupling assembly to the user. The user then adjusts or otherwise actuates the coupling assembly to decouple or disengage the torque transmission shaft from the drain cleaning cable. When utilizing the previously described coupling assembly 50, the user unscrews the grip nut 150 from the threaded coupler 170 so that the torque transmission shaft 70 may axially move past the fingers 176 of the coupler 170. When utilizing the previously described quick change coupling assembly 200, the user axially moves the quick release sleeve 250 away from the quick release coupling 270 to thereby expose the one or more locking ball(s) positioned in corresponding ball capture regions 277. Upon sufficient axial movement of the sleeve 250, the ball(s) may then disengage from their former position(s) in retention depression(s) 75 of the torque transmission shaft 70. This in turn enables axial movement of the torque transmission shaft relative to the drain cleaning cable. When using the previously described coupling assembly 300, the user urges the sleeve 350 toward the lock body 370, and then rotates the sleeve 350 relative to the shaft 70 and lock body 370 to loosen the primary spring 310 out of frictional engagement with the shaft 70. This enables axial movement of the shaft 70 relative to the drain cleaning cable.

After desired positioning of the drain cleaning cable relative to the torque transmission shaft, the coupling assembly is actuated to thereby couple or engage the torque transmission shaft to the drain cleaning cable. This locks or secures the components together so that the user can push or otherwise displace the torque transmission shaft and urge the coupling assembly back into the hollow interior of the auger housing. Such movement also causes extension of the distal end of the cable housing and auger tool attached thereto, relative to the distal end of the auger housing. As will be appreciated, this enables the user to urge the auger tool further into the drain to clear blockages.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described and/or illustrated in association with an embodiment and another feature is described and/or illustrated in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A toilet auger having an extendable drain cleaning cable, the auger comprising:

an auger housing defining a proximal end, an opposite distal end, and a hollow interior extending between the proximal end and the distal end of the housing;

a drain cleaning cable at least partially disposed in the housing, the cable defining a proximal end, an opposite distal end, and a hollow interior extending between the proximal end and the distal end of the cable;

a coupling assembly engaged with the proximal end of the drain cleaning cable, the coupling assembly including a torsion lock body defining a proximal end, a distal end, an interior passage extending between the proximal and distal ends, and a locking groove region, the locking groove region including a circumferentially extending portion and an axially extending portion;

a torque transmission shaft at least partially disposed in the hollow interior of the drain cleaning cable, the torque transmission shaft defining a proximal end and an opposite distal end;

wherein the coupling assembly enables selective engagement between the torque transmission shaft and the cable, the coupling assembly sized and configured to be slidably positionable within the hollow interior of the housing;

a torsion lock sleeve defining a proximal end, a distal end, an interior passage extending between the proximal and distal ends, and at least one aperture providing access to an interior region of the torsion lock sleeve, the interior region accessible from the distal end of the sleeve;

wherein the proximal end of the torsion lock body is positioned within the interior region of the torsion lock sleeve such that the locking groove region is disposed under and aligned with the aperture defined in the torsion lock sleeve.

2. The toilet auger of claim 1 wherein the coupling assembly further includes:

a securing element releasably disposed in the aperture defined in the torsion lock sleeve.

3. The toilet auger of claim 2 wherein an inner face of the securing element is disposed in the locking groove region of the torsion lock body.

4. The toilet auger of claim 1 wherein the coupling assembly further includes:

a primary biasing member disposed between the torsion lock body and the torsion lock sleeve.

5. The toilet auger of claim 4 wherein the primary biasing member is a torsion spring.

6. The toilet auger of claim 4 wherein the coupling assembly further includes: a secondary biasing member disposed between the torsion lock body and the torsion lock sleeve.

7. The toilet auger of claim 6 wherein the secondary biasing member is a compression spring.

8. The toilet auger of claim 6 wherein the primary biasing member is at least partially disposed within the secondary biasing member.

9. A coupling assembly for selectively engaging and disengaging a torque transmission shaft and a drain cleaning cable, the coupling assembly comprising:

a torsion lock body defining a proximal end, a distal end, an interior passage extending between the proximal and distal ends, and a locking groove region, the locking groove region including a circumferentially extending portion and an axially extending portion;

a torsion lock sleeve defining a proximal end, a distal end, an interior passage extending between the proximal and distal ends, and at least one aperture providing access to an interior region of the torsion lock sleeve, the interior region accessible from the distal end of the sleeve;

wherein the proximal end of the torsion lock body is positioned within the interior region of the torsion lock sleeve such that the locking groove region is disposed under and aligned with the aperture defined in the torsion lock sleeve.

10. The coupling assembly of claim 9 wherein the coupling assembly further includes:

a securing element releasably disposed in the aperture defined in the torsion lock sleeve.

11. The coupling assembly of claim 10 wherein an inner face of the securing element is disposed in the locking groove region of the torsion lock body.

12. The coupling assembly of claimed 9 wherein the coupling assembly further includes:

a primary biasing member disposed between the torsion lock body and the torsion lock sleeve.

13. The coupling assembly of claim 12 wherein the primary biasing member is a torsion spring.

14. The coupling assembly of claim 12 wherein the coupling assembly further includes:

a secondary biasing member disposed between the torsion lock body and the torsion lock sleeve.

15. The coupling assembly of claim 14 wherein the secondary biasing member is a compression spring.

16. The coupling assembly of claim 14 wherein the primary biasing member is at least partially disposed within the secondary biasing member.

17. A toilet auger having an extendable drain cleaning cable, the auger comprising:

an auger housing defining a proximal end, an opposite distal end, and a hollow interior extending between the proximal end and the distal end of the housing;

a drain cleaning cable at least partially disposed in the housing, the cable defining a proximal end, an opposite distal end, and a hollow interior extending between the proximal and the distal end of the cable;

a torque transmission shaft at least partially disposed in the hollow interior of the drain cleaning cable, the torque transmission shaft defining a proximal end and an opposite distal end;

wherein the torque transmission shaft is slidably disposed within the hollow interior of the drain cleaning cable and can be axially moved relative to the drain cleaning cable.

18. The toilet auger of claim 17 further comprising;

a coupling assembly engaged with the proximal end of the drain cleaning cable.

19. The toilet auger of claim 17 wherein the torque transmission shaft has a cross sectional shape in the form of a polygon with n sides.

* * * * *